US005383655A

United States Patent [19]

Hayakawa et al.

[11] Patent Number: 5,383,655

[45] Date of Patent: Jan. 24, 1995

[54] SHEET FEEDING APPARATUS

[75] Inventors: Yasuyoshi Hayakawa; Teruo Komatsu; Hironobu Isobe, all of Yokohama; Atsushi Kubota, Machida, all of Japan

[73] Assignee: Canon Kabushiki Kaisha, Tokyo, Japan

[21] Appl. No.: 139,870

[22] Filed: Oct. 22, 1993

Related U.S. Application Data

[63] Continuation of Ser. No. 853,862, Mar. 20, 1992, abandoned, which is a continuation of Ser. No. 426,401, Oct. 25, 1989, abandoned.

[30] Foreign Application Priority Data

| | | | |
|---|---|---|---|
| Oct. 31, 1988 | [JP] | Japan | 63-275399 |
| Nov. 22, 1988 | [JP] | Japan | 63-296737 |
| Dec. 16, 1988 | [JP] | Japan | 63-317695 |
| Dec. 16, 1988 | [JP] | Japan | 63-317696 |

[51] Int. Cl.[6] ..... B65H 5/00; B65H 3/00

[52] U.S. Cl. ..... 271/10; 271/117; 271/121; 271/164

[58] Field of Search ..... 271/117, 121, 124, 162, 271/164

[56] References Cited

U.S. PATENT DOCUMENTS

| | | | |
|---|---|---|---|
| 4,083,553 | 4/1978 | Beck | 271/117 X |
| 4,595,191 | 6/1986 | Uchiyama et al. | 271/170 |
| 4,740,817 | 4/1988 | Suzuki | 271/164 X |
| 4,787,616 | 11/1988 | Sasaki et al. . | |
| 4,793,606 | 12/1988 | Yasuoka | 271/164 X |

FOREIGN PATENT DOCUMENTS

| | | | |
|---|---|---|---|
| 0201711 | 11/1986 | European Pat. Off. . | |
| 59-4534 | 11/1984 | Japan . | |
| 191340 | 8/1987 | Japan | 271/117 |

*Primary Examiner*—H. Grant Skaggs

*Attorney, Agent, or Firm*—Fitzpatrick, Cella, Harper & Scinto

[57] ABSTRACT

A sheet feeding apparatus comprising a sheet accommodator for accommodating sheets and movable in a predetermined direction from a sheet-feeding position; a feeding device for feeding sheets accommodated in said sheet accommodator held at said sheet-feeding position in said direction; a friction member for permitting feeding of only one of sheets fed out from said feeding device while blocking the feeding of the remaining sheets; and a support for supporting said friction member such that said friction member can be moved to a first position for separating a sheet, and to a second position for permitting movement of said sheet accommodator in said direction.

18 Claims, 25 Drawing Sheets

SHEET FEEDING APPARATUS

This application is a continuation of application Ser. No. 07/853,862 filed Mar. 20, 1992, which is a continuation of application Ser. No. 07/426,401 filed Oct. 25, 1989, both now abandoned.

BACKGROUND OF THE INVENTION

1. Field of the Invention

This invention relates to a sheet feeding apparatus (sheet feeder) for feeding sheets (i.e., cut sheets such as copying sheets, transfer sheets and recording sheets) accommodated in sheet accommodation means to an apparatus for executing a given process such as image formation (for instance a copier or a printer of LED, laser beam, ink jet or wire dot type).

Related Background Art

Sheet feeders are used in electrophotographic copiers, laser beam printers, liquid crystal shutters, LED printers and ink jet printers. An example of sheet feeder will be described with reference to FIG. 27 in conjunction with a laser beam printer (hereinafter referred to as "LBP") using a laser beam.

In FIG. 27 reference numeral 100 designates a printer housing, in which means for forming an image on a sheet is contained. The housing 100 consists of two separate parts, i.e., lower and upper parts 100A and 100B. Upper part 100B is hinged at the rear end by hinge shaft 101 to lower part 100A so that it can be opened as shown by the phantom line and closed as shown by the solid line.

Paper or like sheets S are accommodated in cassette 109 serving as sheet accommodation means and mounted in housing 100. These sheets S are fed one by one by feed rollers 111*a* and 111*b* and guides 112 and 113 to regist rollers 114.

Each sheet S is fed by regist rollers 114 to a process cartridge 102, which serves to form image, by regist rollers 114 in synchronism to an image signal. An image is then transferred to the sheet by transfer charger 116, and the sheet is then fed by separation belt 117 to fixing unit 118. In the fixing unit, the image is fixed on the sheet as the sheet is squeezed between fixing rollers, and then the sheet is discharged from discharge port 110D.

An image formation unit includes laser beam scanner 107, in which a laser (not shown) provided in upper half 100B of housing is operated in the axial direction of an image carrier, and process cartridge 102, in which well-known electrophotographic process units are collectively provided.

Laser beam scanner 107 provides laser beam L which is led by mirror 108 to image carrier 103. Charging unit 104, developing unit 105 and cleaning unit 106 are provided as main components in process cartridge 102.

The prior art sheet feeder having the above construction has the following drawbacks.

(1) The sheet feeder section is disposed in the depth of apparatus in the direction of mounting of the sheet accommodation means. Inconvenience, therefore, is felt in the maintenance of the feed rollers and other components.

(2) When jamming occurs, it is necessary to open the large upper half 110B of housing and also open U-turn guide 120 on the side opposite to the side on which the sheet accommodation means is mounted and dismounted, for removing jammed sheets. This operation involves many steps, and the operability is rather unsatisfactory.

Japanese Patent Laid-open No. 59-4534 discloses a construction, in which a cassette can be pulled out from the side of a sheet feeder section. This disclosed sheet feeder adopts a sheet feeder system of separation pawl type using D-shaped feed rollers.

With the D-shaped feed rollers, however, limitation is imposed on the distance of feed, and separate feed rollers have to be provided after the sheet feeder section.

Besides, the sheet feeder system using the separation pawl is not suited so much for feeding thick double-side printing sheets, for which the demand is recently increasing, and also special sheets such as envelopes, that is, a limitation is imposed on sheets that can be dealt with, thus leading to sacrifice in the freedom of the operating status and design of the apparatus.

SUMMARY OF THE INVENTION

An object of the invention is to provide a sheet feeder, in which sheet-feeding means for feeding sheets is disposed such that it is movable from a path of loading sheet accommodation means, and sheet-separating-/feeding means consisting of friction means is disposed in the vicinity of an opening for loading and unloading the sheet accommodation section.

According to the invention, there is provided a sheet feeder having a sheet-feeding section disposed in the neighborhood of an opening for loading and unloading a sheet accommodation means for feeding sheets to a housing of associated apparatus, in which sheet-feeding means is capable of being moved from the path of loading the sheet accommodation means, thus permitting provision of sheet-separating/feeding means consisting of friction means, which has heretofore been difficult.

Further, according to the invention the movable sheet-feeding means can reverse a feeding roller in an interlocked relation to the movement of sheet feeder, thus returning sheets to the sheet accommodation means and releasing the friction means. It is thus possible to prevent breakage of sheet fed to the sheet-feeding section at the time of loading or unloading of the sheet accommodation means or damage to the apparatus by sandwiched sheet.

In addition, it is possible to improve the operability when inserting the sheet accommodation means into the apparatus.

Further, according to the invention releasing means for releasing a holding member for holding the friction means in an interlocked relation to the operation of loading the sheet accommodation means. Thus, there is no need of releasing the holding means manually every time the sheet accommodation means is loaded, and the operability is thus improved. Further, the releasing operation can be caused at a predetermined timing, thus eliminating the possibility of destroying the apparatus with an erroneous procedure of operation.

Further, according to the invention there is provided an image-forming apparatus, which has sheet accommodation means accommodating a stack of sheets and capable of being mounted in and dismounted from a housing of the apparatus, and in which a feeding roller for feeding sheets into the housing and feeding means consisting of friction means facing the feeding roller or a roller disposed thereafter are provided in the vicinity of an opening for insertion of the sheet accommodation means, and in which the sheet-feeding means can be moved to a first position for feeding sheets and to a second position for permitting the loading and unloading of the sheet accommodation means with respect to the housing.

DETAILED DESCRIPTION OF PREFERRED EMBODIMENT

Now, a first embodiment of the invention will be described with reference to FIGS. 1 to 3.

Figure 1:
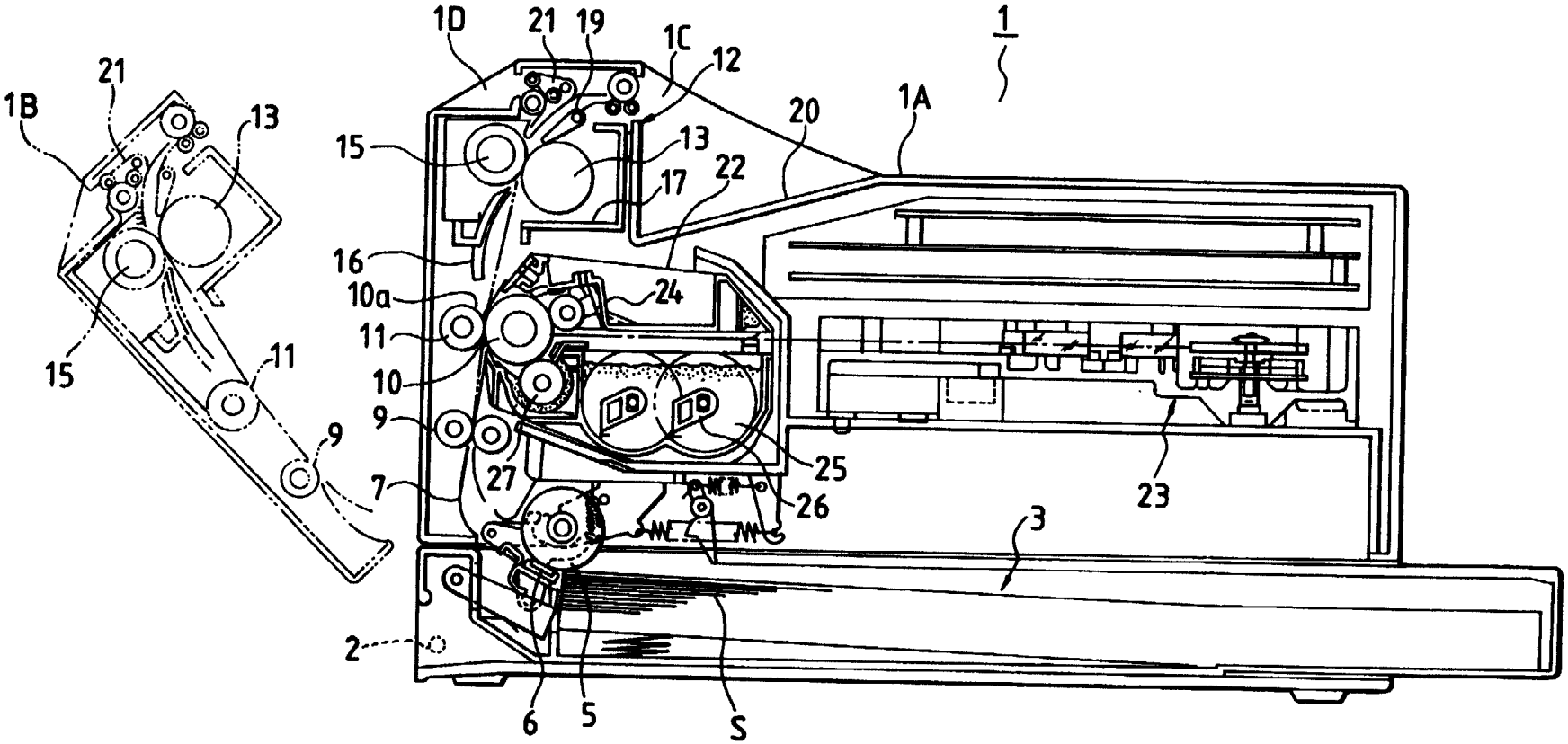
FIG. 1 is a sectional view showing an image-forming apparatus embodying the invention.

FIG. 1 is a sectional view showing a laser beam printer embodying the invention. Referring to the FIG. 1, the printer has housing 1, which consists of stationary part 1A and pivotal part 1B pivoted to stationary part 1A. A transport path, along which sheets S such as paper sheets as transfer medium are transported, is divided between stationary and pivotal parts 1A and 1B. Pivotal part 1B is pivotable about shaft 2. Transfer material sheets S are accommodated in sheet cassette 3 as sheet accommodation means. As feeding roller 5 is rotated, sheets S are separated one by one by feeding roller 5 and separating pad 6 consisting of a high friction member urged by feeding roller 5.

Each separated sheet S is fed along guide 7 to a pair of resist rollers 9 to be fed to transfer section 10*a* in synchronism to an image formed on image carrier (i.e., photosensitive drum) 10. Fixing unit 12 includes pressure application roller 14 for urging the separated sheet S against heater roller 13 including a heater, guide 16 for guiding sheet S to between heater roller 13 and pressure application roller 15 in contact with each other, cover 17 and separating pawl 19.

After an image transferred to sheet S is fixed, sheet S is discharged from discharge port 1C to be stacked on tray 20. Flapper 21 is provided between fixing unit 12 and discharge port 1C. By switching flapper 21 in position, the direction of transport of sheet S can be changed to cause sheet S to be discharged from discharge port 1D. At this time, sheet S is discharged with image side as its upper surface.

The image-forming section includes process cartridge 22, which collectively accommodates components for executing various steps of a well-known Carlson type image-forming process, and laser beam scanner 23 for scanning laser beam L in the axial direction of photosensitive drum 10. Photosensitive drum 10 is further charged by charging roller 24, and an electrostatic latent image is formed on the drum by the laser beam provided by laser beam scanner 23. Tonor t in developing unit 25 is supplied by agitating member 26 to a developing section and thinly coated on developing sleeve 27. The coated toner t is attached to photosensitive drum 10 to effect development, and the visual image thus formed is transferred in transfer section 10*a* noted above onto transfer medium sheet S.

The sheet-feeding section Using the sheet feeder according to the invention will now be described in detail with reference to FIGS. 2 and 3.

Figure 2:
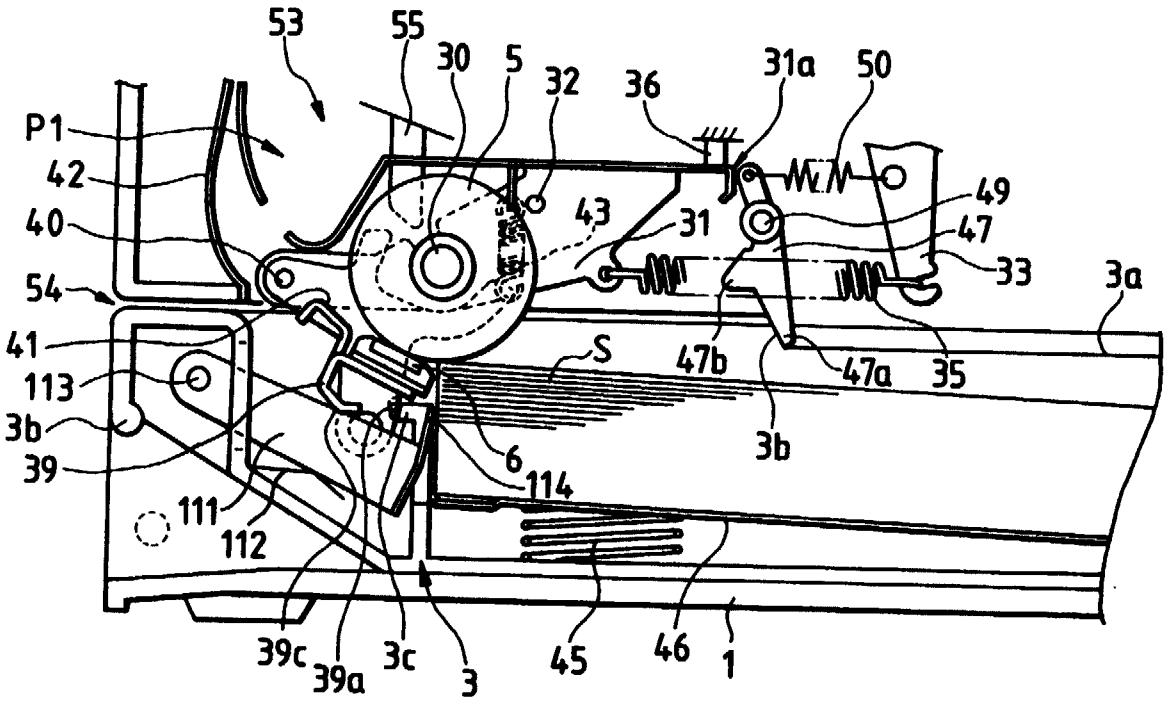
FIG. 2 is a sectional view showing a first embodiment of the sheet feeder according to the invention.

FIG. 2 shows a sheet-feeding section using a first embodiment of the invention in a state capable of feeding sheets.

Sheet supplying shaft 30 with feeding roller 5 mounted thereon is rotatably mounted via bearings (not shown) in side plates 31. Side plates 31 are rotatably mounted by shaft 32 on housing 1. Side plates 31 are biased in the counterclockwise direction in FIG. 2 by the spring force of tension spring 33, which has its opposite ends attached to each side plate 31 and stationary member 33, respectively. Side plates 36 are positioned with their rear end (i.e., right end in FIG. 2) held in contact with a predetermined force with stationary contact member 36. Feeding roller 5 is rotated with predetermined sheet-feeding timing by a drive motor (not shown) secured to the housing, a plurality of gears (one being secured to the shaft of feeding roller 5 and another being secured to the housing and coupled to the motor) and a clutch. The afore-mentioned gears can be meshed with each other.

Separating pad 6 is secured to support 39, which is rotatably mounted by shaft 40 in side plates 31. Support 31 has sheet guide 41 disposed after separation pad 6 for reliably feeding each fed-out sheet S into between pair guides 42 provided on the side of housing 1. Pressure application spring has one end attached to side plate 31 and the other end attached to support 39, and separating pad 6 urged against a lower portion of the periphery of feeding roller 5 by the spring force of pressure application spring 43.

Sheets S accommodated together with inner plate 46 in cassette 46 are urged against the outer periphery of feeding roller 5 with a constant pressure provided by the spring force of compression spring 45 provided in cassette 3 irrespective of the number of sheets S in the stack.

The inner surface of each side wall of cassette 3 is formed with stepped portion 3*a* extending from an intermediate position of cassette 3 to end 7 thereof, from which sheets are inserted (i.e., right end in FIG. 2). Locking member 47 has lower portion 47*a* extending into stepped portion 3*a*. It is pivoted by pin 49 to housing 1 and biased in the clockwise direction in FIG. 2 by the spring force of tension spring 50 with the ends thereof attached to stationary member 33 and locking member 47, respectively. By this biasing force, lower portion 47*a* of locking member 47 is held in contact with contact surface 3*b* constituted by end surface of stepped portion 3*a*.

The sheet-feeding operation of the sheet-feeding section having the above construction will now be described.

As feeding roller 4 is rotated at a predetermined sheet-feeding timing, the uppermost sheet S in contact with feeding roller 5 is fed out from cassette 3 (which serves as sheet accommodation means) by the frictional force of feeding roller 5. However, sometimes not only a single sheet S but two or more sheets may be fed out at a time due to frictional forces between adjacent sheets S. The overlap-fed sheets S are separated from one another by the difference of friction of contact between feeding roller 5 and separating pad 6 and are thus fed one by one to housing 1.

Rotatable side plates 31 noted above, support 39 pivoted thereto and separating pad 6 mounted on support 39 and capable of being brought into contact with and separated from feeding roller 5 constitute, together with feeding roller 5, a sheet-feeding unit for feeding sheets S. In FIG. 2, sheet-feeding unit 53 is shown in its first position P for feeding sheets S. In this position of the unit, feeding-roller 5 is slightly pushing down inner plate 46 via the stack of sheets S and thus forming a slight gap with respect to restriction means to be described later.

Figure 3:
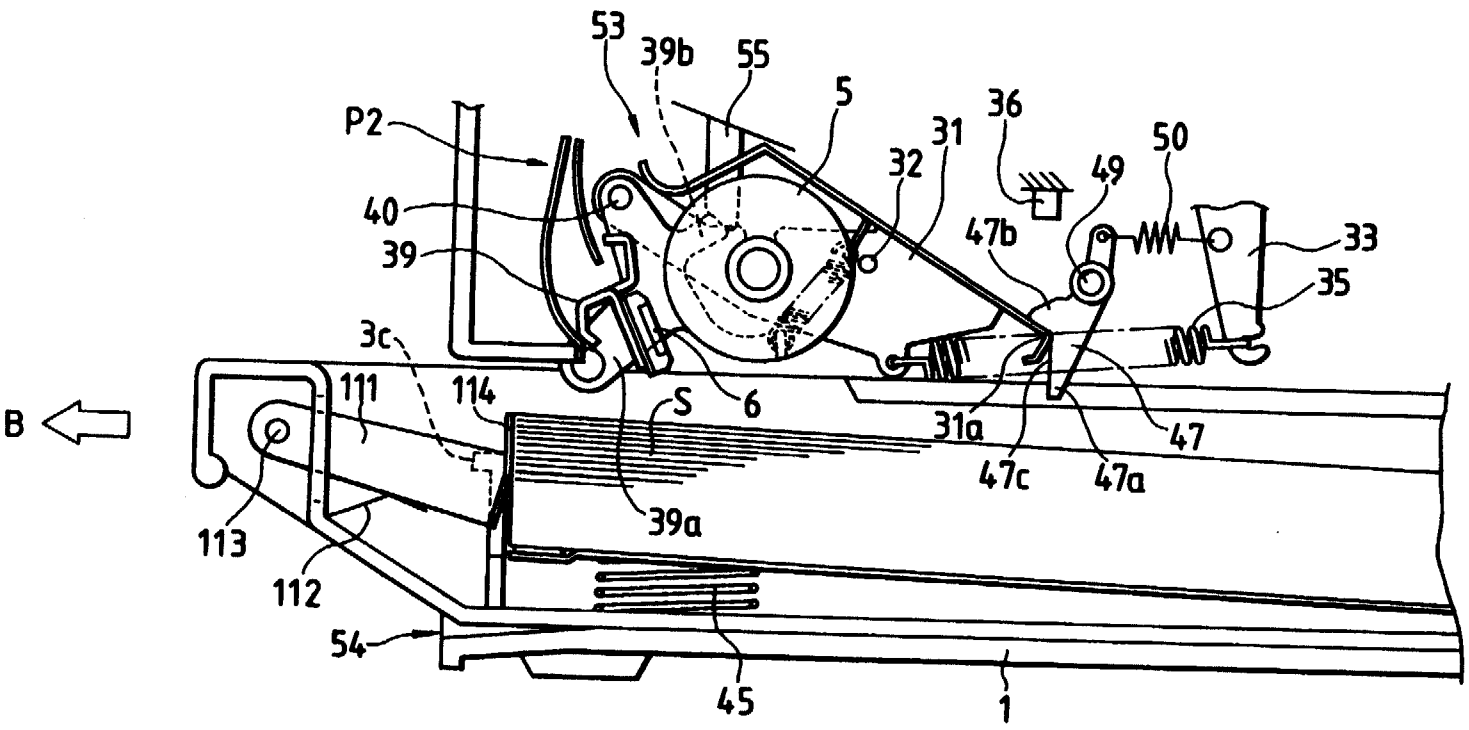
FIG. 3 is a view similar to FIG. 2 for explaining the function of the same embodiment.

FIG. 3 shows sheet-feeding unit 53 when cassette 3 is withdrawn in the direction of arrow B from housing 1. While inner plate 46 is upwardly biased by spring 45, rising of it is restricted by restricting means provided in the cassette. In the vicinity of sheet-feeding unit 53 of housing 1, there is provided cassette insertion/withdrawal opening 54, through which cassette 3 can be inserted and withdrawn. When sheet-feeding unit 53 is at its first position P1 shown in FIG. 2, by withdrawing cassette 3 by gripping grip 3*b* for the purpose of replenishing it with sheets S or the like, contact portion 3*c* provided on front wall of cassette 3 pushes contact portion 39*a* of support 39. As a result, sheet-feeding unit 53 is rotated in the clockwise direction in FIG. 5 about shaft 32 against the spring force of tension spring 35.

When sheet-feeding unit 53 is rotated in the clockwise direction, arm 39*b* of support 39 strikes stopper 55 provided on housing 1 to cause rotation of support 39 in the clockwise direction relative to stopper 55. Separating pad 6 is thus separated from feeding roller 5 as shown in FIG. 3. Further with the rotation of side plates 31 noted above, rear end 31*a* thereof pushes projection 47 of locking member 47 to cause rotation thereof in the counterclockwise direction. When rear end 31*a* of side plate 31 clears projection 47*b* and is engaged in recess 47*c* as shown in FIG. 3, side plate 31 is locked by locking member 47. Sheet-feeding unit 53 thus is held at a retreated position or second position P2, at which cassette 3 can be inserted into or withdrawing from housing 1.

With the rotation of sheet-feeding unit 53 about shaft 32 to second position P2, feeding roller 5 and separating pad 6 are retreated upwardly from their operative position shown in FIG. 2 to the retreated position shown in FIG. 3. In this state, feeding roller 5 or separating pad 6 are held at positions free from interference with cassette 3 while cassette 3 is inserted or withdrawn. Further, since separating pad 6 is held spaced apart from feeding roller 5 as shown in FIG. 3 as a result of the action described above. Thus, sheets S between feeding roller 5 and separating pad 6 may be readily removed.

Now, description will be made in connection with the case of inserting cassette 3 into housing 1.

Since sheet-feeding unit 53 is held retreated in the second position by the locking action of locking member 47 noted above, the path of insertion of cassette 3 is open. When cassette 3 is inserted up to the vicinity of a predetermined sheet-feeding position, contact surface of stepped portion 3*a* provided in side plate of cassette 3 pushes lower portion 47*a* of locking member 47 to cause rotation of locking member 47 in the counterclockwise direction in FIG. 3 against the spring force of tension spring 50.

With the rotation of locking member 47 the recess 47*c* and rear end 31*a* of side plate 31 are disengaged from each other to release the locking action on the sheet-feeding unit 53. Sheet-feeding unit 53 is thus rotated about shaft 32 in the counter-clockwise direction from the second position shown in FIG. 3 by the spring force of tension spring 35. At the start of this rotation, support 39 is rotated in the counterclockwise direction relative to side plate 31 by the spring force of tension spring 43. As a result, separating pad 6 provided on support 39 is brought into contact again with a lower portion of the outer periphery of feeding roller 5. Sheet-feeding unit 53 is rotated in the counterclockwise direction until the rear end of side plate 31 strikes contact member 36. In this state, feeding roller 5 is in contact the uppermost sheet S in cassette 3, and sheet-feeding unit 53 is held at the first position shown in FIG. 2 for feeding sheets.

Meanwhile, cassette 3 receives force in the leftward direction in the FIG. 3, i.e., in the direction of detachment, due to frictional force provided via sheets with the rotation of sheet-feeding roller 5. However, contact portion 39*a* of separating pad support 39 and contact portion 3*c* of cassette 3 are in contact with a stronger force of contact than the frictional force of feeding roller 5 tending to withdraw cassette 3. In this state, cassette 3 is prevented from being occasionally withdrawn from the housing.

FIG. 3 shows the sheet-feeding section when cassette 3 is taken out from housing 1. When cassette 3 is withdrawn from the operative state shown in FIG. 2 for the purpose of replenishment with sheets or the like. Contact portion 3*c* provided on cassette 3 pushes contact portion 39*a* of support 39 in the leftward direction shown in FIG. 3 against the biasing force of tension spring 35.

Figure 4:
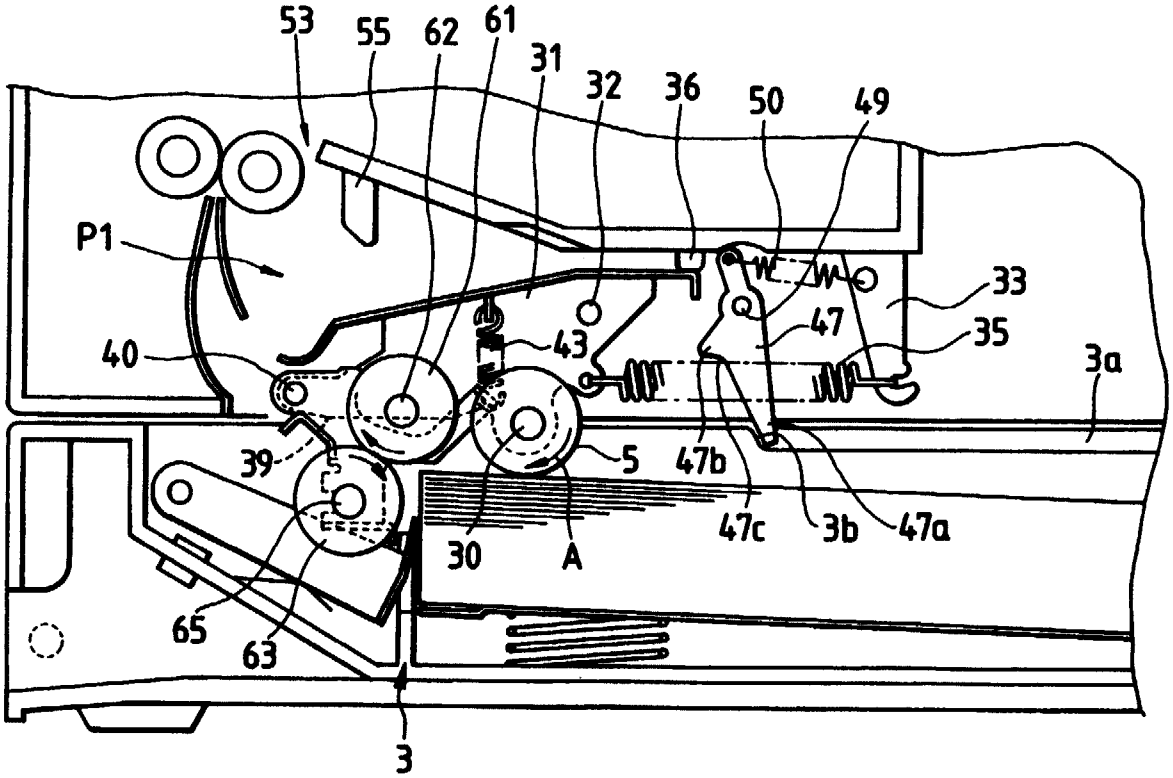
FIG. 4 is a sectional view showing a second embodiment of the sheet feeder according to the invention.
Figure 5:
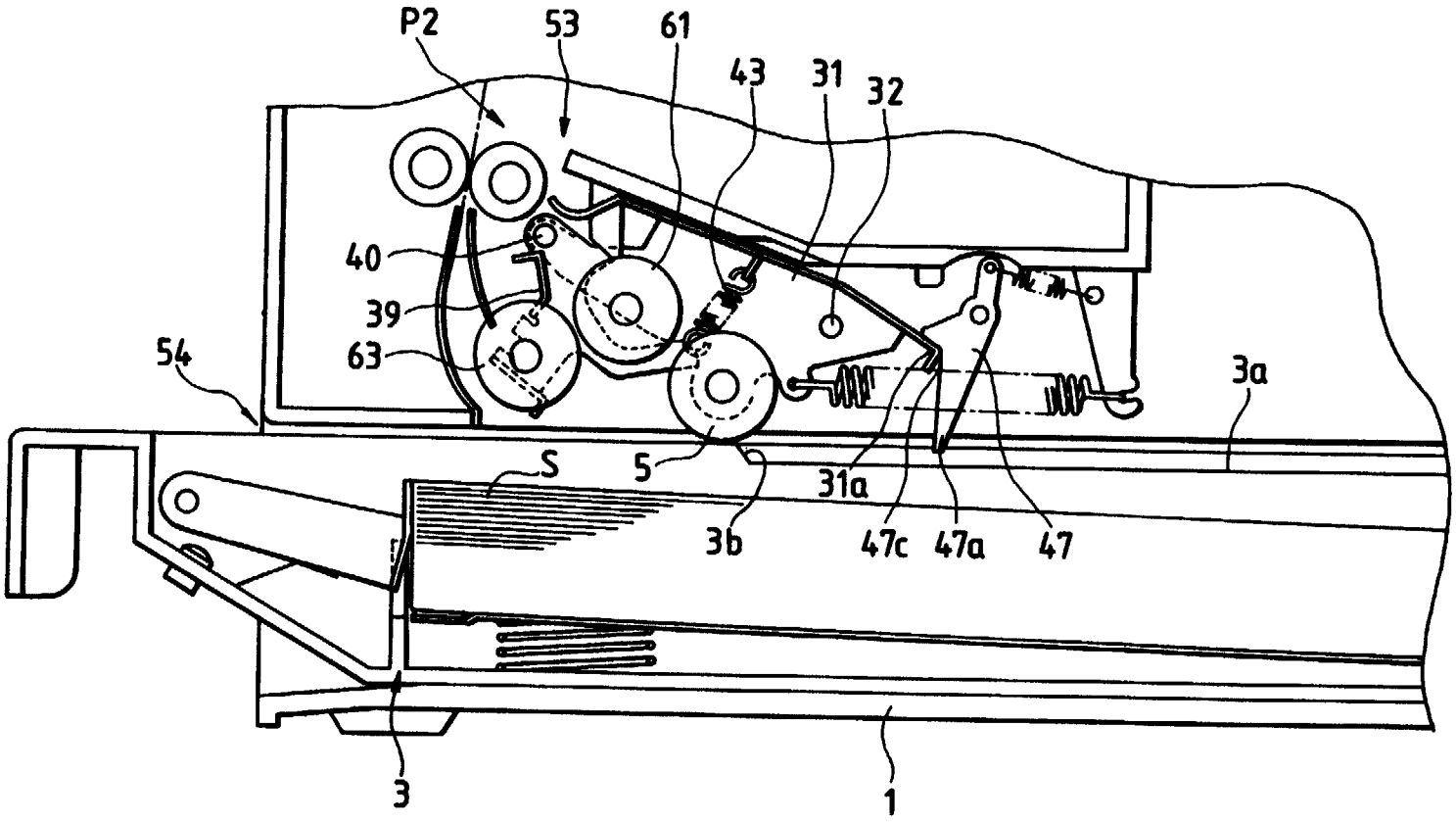
FIG. 5 is a view similar to FIG. 4 for explaining the function of the same embodiment.

FIGS. 4 and 5 show a second embodiment of the invention. In the first embodiment shown in FIGS. 2 and 3, sheet-feeding unit 53 adopts pad sheet-feeding system, in which double fed sheets are separated by using separating pad 6 urged with a predetermined pressure against feeding roller 5. In the second embodiment shown in FIGS. 4 and 5, a retard roller system is employed for the separation of double fed sheets.

Referring to FIG. 4, second transporting roller 61 is rotatably mounted by shaft 62 on side plates 31 after feeding roller 5. Separating roller 61 is rotatably mounted by shaft 61 on support 39, and with the rotation of feeding roller 5 it is rotated in the same direction. Separating roller 63 is rotatably mounted by shaft 65 on support 39. It is urged against second transporting roller 62 by the spring force of tension spring 43 biasing support 39, and is rotated in the opposite direction to the direction of transport of sheets S. It faces the second transporting roller 61 and includes a torque limiter so as to permit its rotation with second transporting roller 61 when a torque in excess of a predetermined frictional force is exerted to second transporting roller 61, thus effecting separation of double fed sheets.

When cassette 3 is withdrawn from housing 1, its contact portion 3*c* pushes and moves contact portion 39*a* of support 39 (see FIG. 5) and as in the first embodiment sheet-feeding unit 53 is rotated to a second position shown in FIG. 5 and locked at that position by locking member 47. Further, when the sheet-feeding unit 53 is rotated, support 39 is rotated relative to side plate 31, and separating roller 63 is separated from second transporting roller 61 as shown in FIG. 5. When inserting cassette 3, as in the case of the first embodiment sheet-feeding unit 53 is returned to the second position for feeding sheets as shown in FIG. 4.

The separating roller pair consisting of second transporting roller 61 and separating roller 63 may be directly mounted on movable side plates 31. As a further alternative, it may be mounted on side plates movable relative to housing 1 such that it may be moved independently of the movement of feeding roller 5.

Further, in the above embodiment sheet-feeding unit 53 is rotated about shaft 32. However, this rotating system may be replaced with a link mechanism or a slide rail mechanism. Further, in the embodiments shown in FIGS. 1 to 5, separating pad 6 and separating roller 63 are mounted on support 39 rotatably mounted on side plates 31 and held in contact with feeding roller 5 or second transporting roller 62 with a predetermined pressure provided by the spring force of tension spring 43. However, they need not be in contact with roller 5 or 62 but may be held such as to provide a predetermined gap between them and the roller. In either case, the same function can be obtained.

Figure 6:
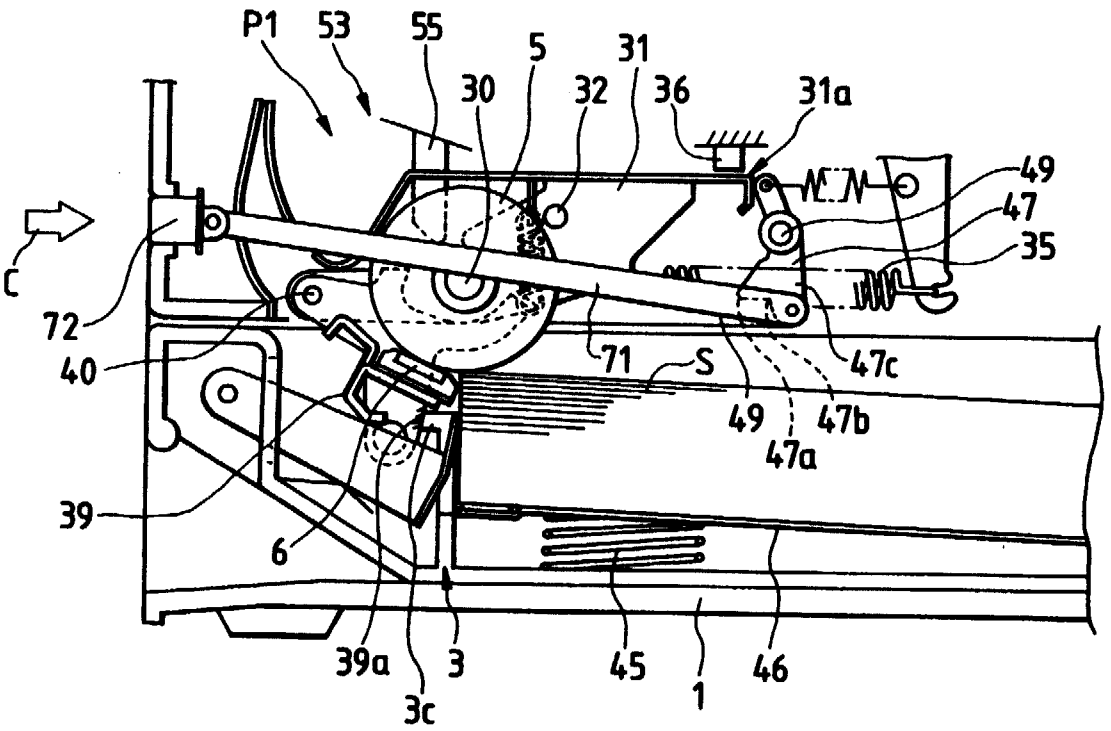
FIG. 6 is a sectional view showing a third embodiment of the invention.
Figure 7:
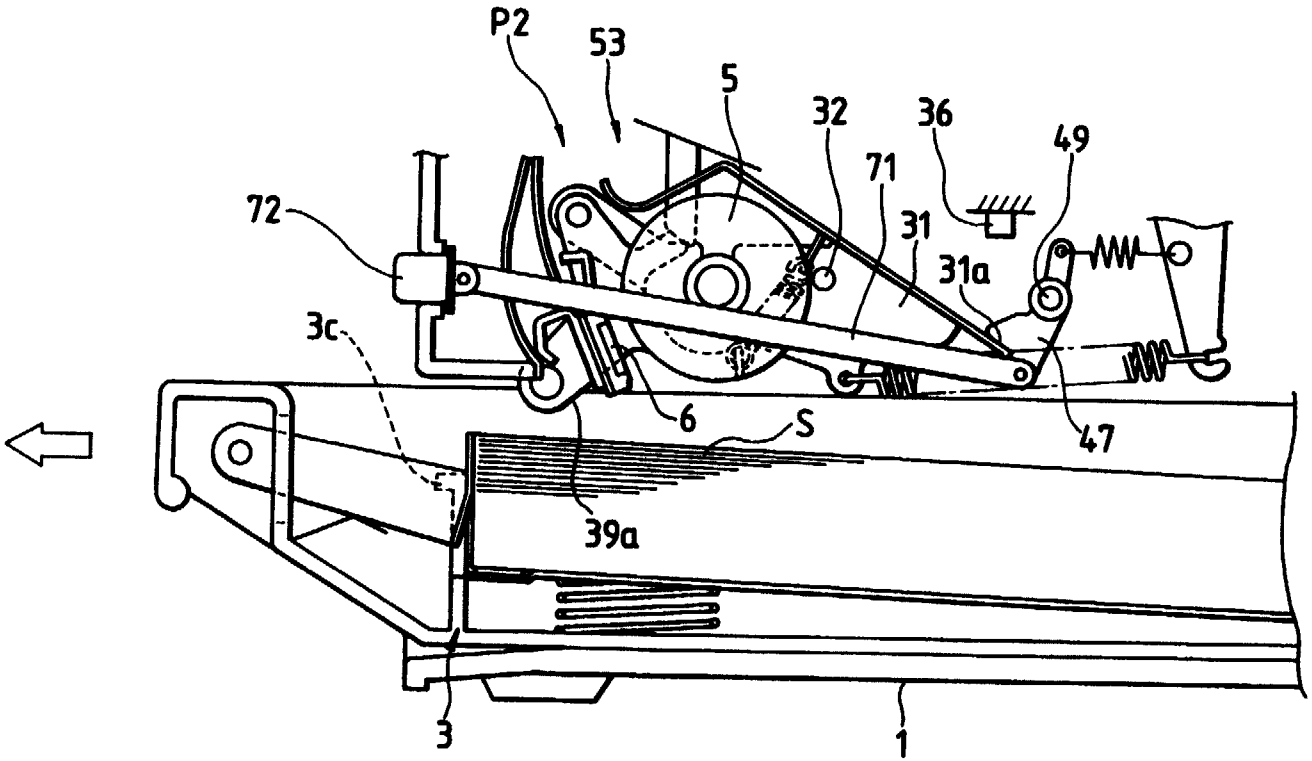
FIG. 7 is a view similar to FIG. 6 for explaining the function of the same embodiment.

FIGS. 6 and 7 show a third embodiment of the invention.

Referring to FIG. 6, the rear end (i.e., right end in FIG. 6) of coupling member 71 is pivoted to lower end 47*c* of locking member 47. The front end of coupling member 71 is pivoted to flanged push button 72 which is loosely fitted on a front portion of housing 1. When cassette 3 is withdrawn from housing 1, sheet-feeding unit 53 is rotated from first position P1 shown in FIG. 6 to second position P2 shown in FIG. 7, as in the previous first and second embodiments. Side plates 31 of sheet-feeding unit 53 are held at second position P2 by locking member 47, while feeding roller 5 and separating pad 6 are at retreated positions to permit insertion and removal of cassette 3.

In the previous first and second embodiments the locked state of sheet-feeding unit 53 is released by inserting cassette into housing 1. In this embodiment, the releasing is effected by depressing push button 72 in the direction of arrow C. When push button 72 is depressed, locking member 47 is rotated in the counterclockwise direction from the locked position shown in FIG. 7 via coupling member 71, and sheet-feeding unit 53 is thus moved to the first position for feeding sheets shown in FIG. 6.

Figure 8:
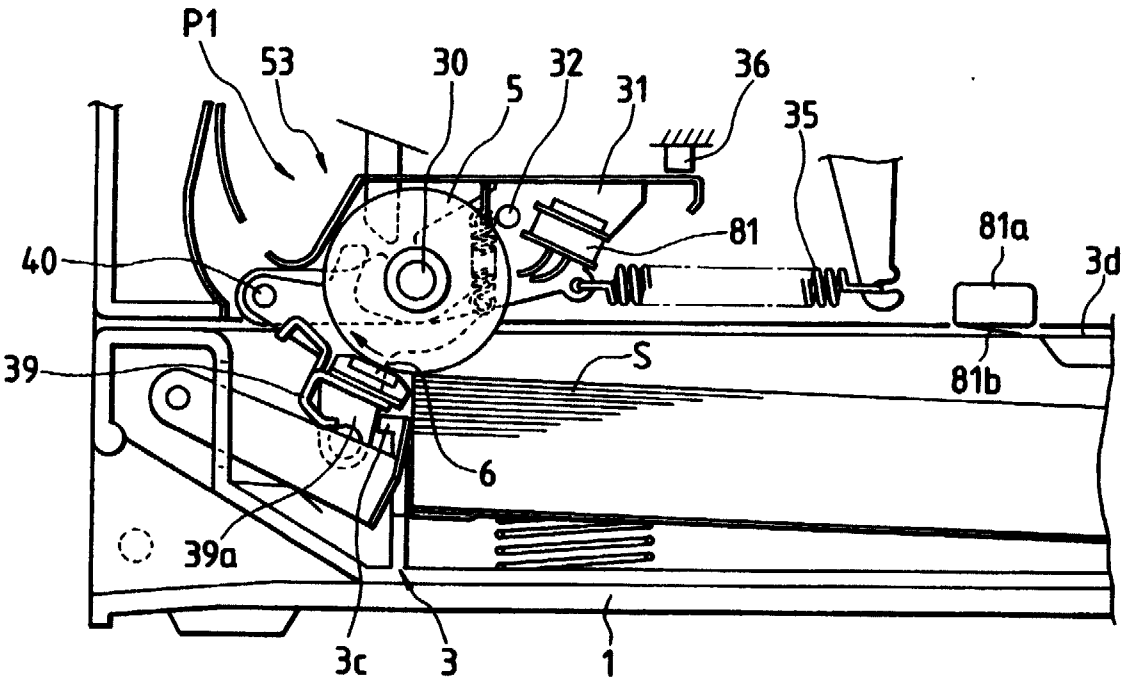
FIG. 8 is a sectional view showing a fourth embodiment of the invention.
Figure 9:
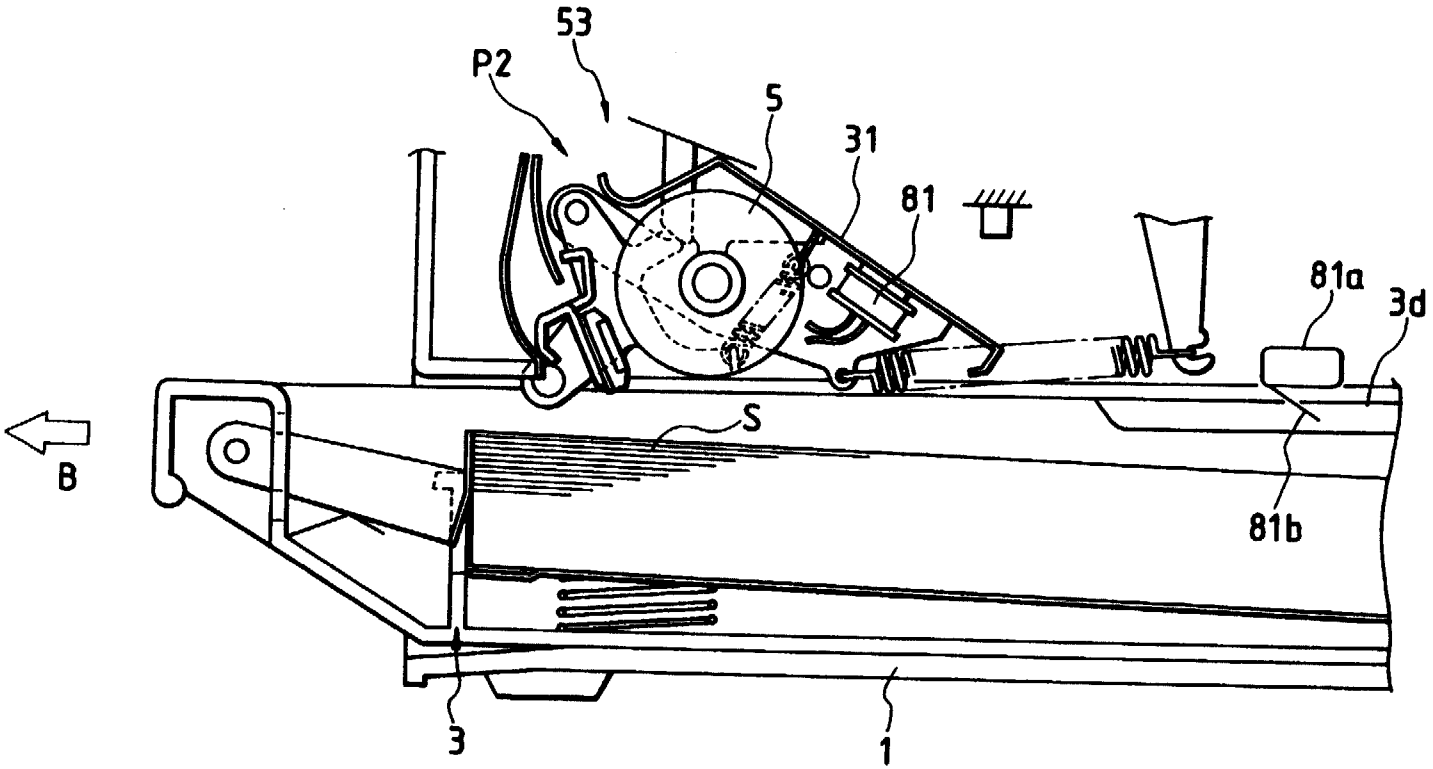
FIG. 9 is a view similar to FIG. 8 for explaining the function of the same embodiment.

FIGS. 8 and 9 show a fourth embodiment of the invention. In this instance, sheet-feeding unit 53, when rotated from first position P1 to second position P2 shown in FIG. 9 with the withdrawal of cassette 3, is locked with side plate 31 attracted to solenoid 81, which is energized by a signal from switch 81*a* which is turned on or off upon detection of the withdrawal of cassette 3.

When cassette 3 is withdrawn, switch 81*a* is turned on with its arm 81*b* falling into groove 3*d* formed in side wall of cassette 3. As a result, solenoid 81 is energized. When cassette 3 is inserted up to a predetermined position, arm 81*b* rides on the side wall of cassette 3 and thus deemenergizes solenoid 81. As a result, sheet-feeding unit 53 is released from the lock and moved from second position P2 to first position P1.

In a sheet-feeding section like that with sheet-feeding unit 53 disposed in the vicinity of a surface, along which cassette 3 is inserted and withdrawn, it has been difficult to use a separating pad and/or a separating roller for doing so may have the path of insertion and withdrawal of cassette 3 (i.e., sheet accommodation means) be blocked by sheet-feeding unit 53. According to the invention, it is possible to use the separating pad and separating roller without possibility of blocking of the cassette insertion/withdrawal path. Thus, a sheet-feeding system using a separating pad and/or a separating roller and having improved sheet-feeding performance can be employed to permit feeding of envelopes and also thick and special sheets as well with sheet-feeding unit 53.

In addition, the operation regarding the jamming of sheets in sheet-feeding unit 53 and maintenance of feeding roller 5 may be carried out with respect to the same plane as the plane, along which cassette is inserted and withdrawn. Further, the image-forming section centered on photosensitive drum 10 and discharge section including discharge tray 20 and discharge port may be operated along a plane above and in the neighborhood of sheet-feeding unit 53. The operability of the entire apparatus thus can be greatly improved.

Further, the sheet path in the apparatus can be extremely reduced, thus permitting improvement of reliability of sheet transport in and great size reduction of the apparatus. Further, main sections of apparatus such as sheet-feeding section, image-forming section, fixing section and discharge section may be disposed in the same direction in the apparatus and separately from electric components such as an interface board and a power source. It is thus possible to realize improvement of the assembling property, reduction of time required for manufacture and reduction of production of rejected product due to erroneous assembling or like causes during manufacture.

Figure 10:
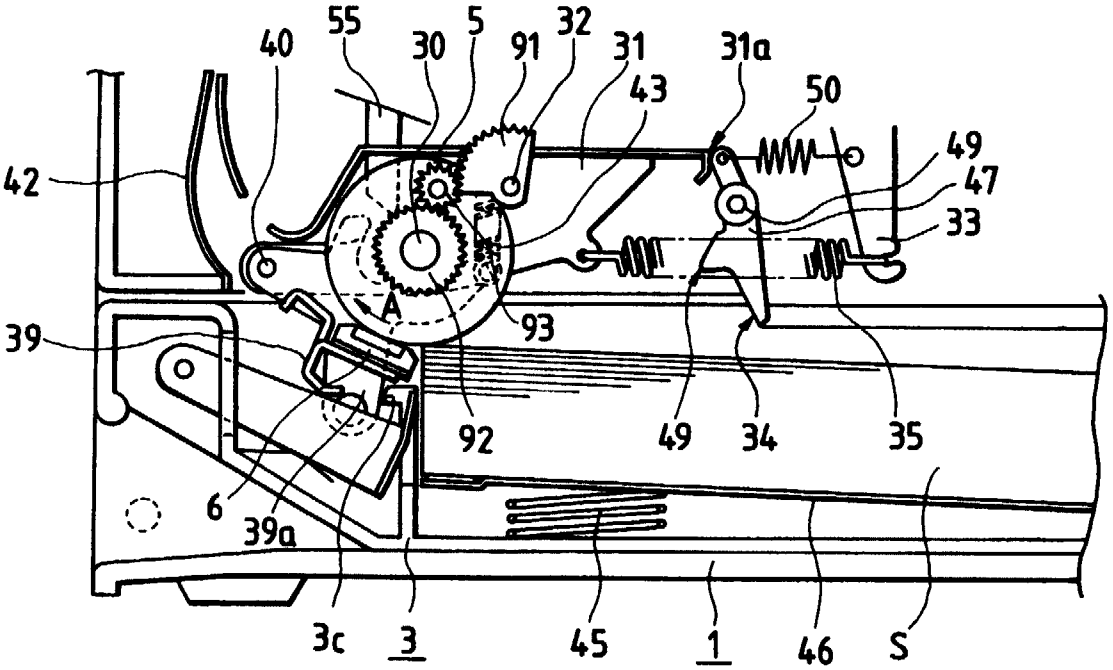
FIG. 10 is a sectional view showing a further embodiment of the invention in a sheet feeding state.
Figure 11:
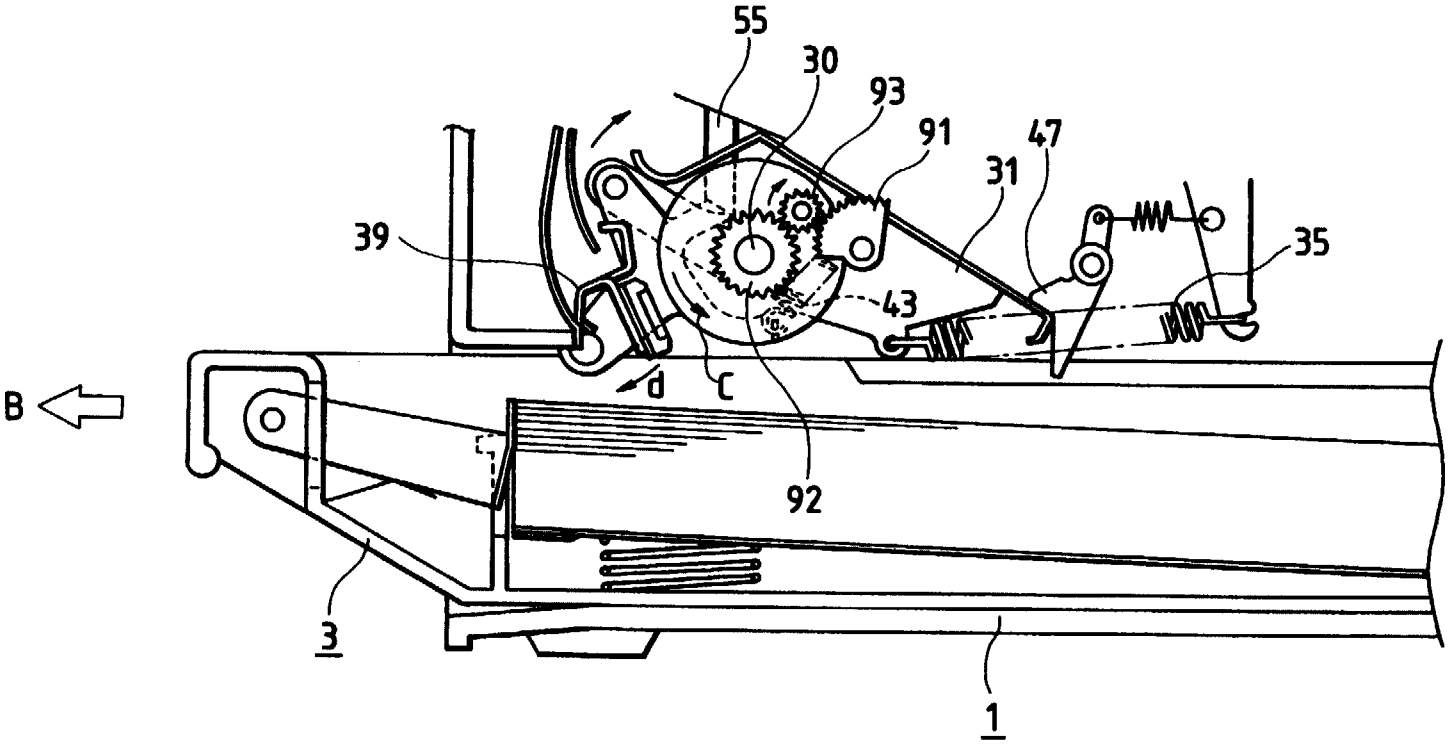
FIG. 11 is view showing a sheet-feeding section in FIG. 10 with a cassette withdrawn.

FIG. 10 shows a further embodiment which has sector gear 91 coaxial with center 32 of rotation of the sheet-feeding unit, gear 92 mounted on the feeding roller shaft and idler gear 93. Sector gear 91 has such a sector shape that it is not in mesh with idler 93 at the position for feeding sheets.

When the sheet-feeding unit is rotated to the retreated position, sector gear 91, which is secured to the housing, is brought into mesh with idler 93 to cause rotation of feeding roller 5 in the opposite direction to the direction of feeding sheets, i.e., in the direction of returning sheets to cassette 3 (shown by arrow C). Thus, when withdrawing cassette 3 from the housing, any sheet that may be found between feeding roller 5 and separating pad 6 can be returned to cassette 3. When the sheet-feeding unit is rotated nearly to the retreated position, contact portion 55 provided on the housing strikes separating pad support 39, thus causing separating pad 6 to be separated from feeding roller 5 (as shown by arrow d) against the biasing force of spring 43 and completely returning sheet between separating pad 6 and feeding roller 5 to the cassette.

When inserting cassette 3 into the housing, gear 92 on the feeding roller shaft is rotated in the direction of feeding sheets by sector gear 91. At this time, however, the feeding roller is not rotated because a one-way clutch provided in gear 92 is decoupled in this state.

This embodiment of sheet feeder uses a sheet-feeding system, in which friction pad 6 for separating double fed sheets is urged with a constant pressure against feeding roller 5. However, it is possible to use for separation of double fed sheets a second transporting roller disposed after feeding roller 5 and a separating roller, which faces the second transporting roller, includes a torque limiter driven when a frictional force in excess of a predetermined level is exerted and is rotated in the opposite direction to the direction of transport.

Further, the separating roller pair, i.e., second transporting roller and separating roller, may be mounted on movable side plates 31 as in the previous first embodiment, or as a further alternative it may be mounted on side plates movable relative to the housing such that it may be moved independently of the movement of the feeding roller.

Further, while the above embodiment of sheet feeder is rotatable about shaft 32, it is possible to use a link mechanism or a slide rail mechanism as well in lieu of the rotary mechanism noted above.

Further, while in the above embodiment friction pad 6 (or separating roller) is mounted on support 39 rotatable relative to side plates and is held in contact with feeding roller 5 or second transporting roller with a predetermined pressure, it need not be in contact with but may be held spaced apart with a predetermined gap from the roller noted above.

Figure 12:
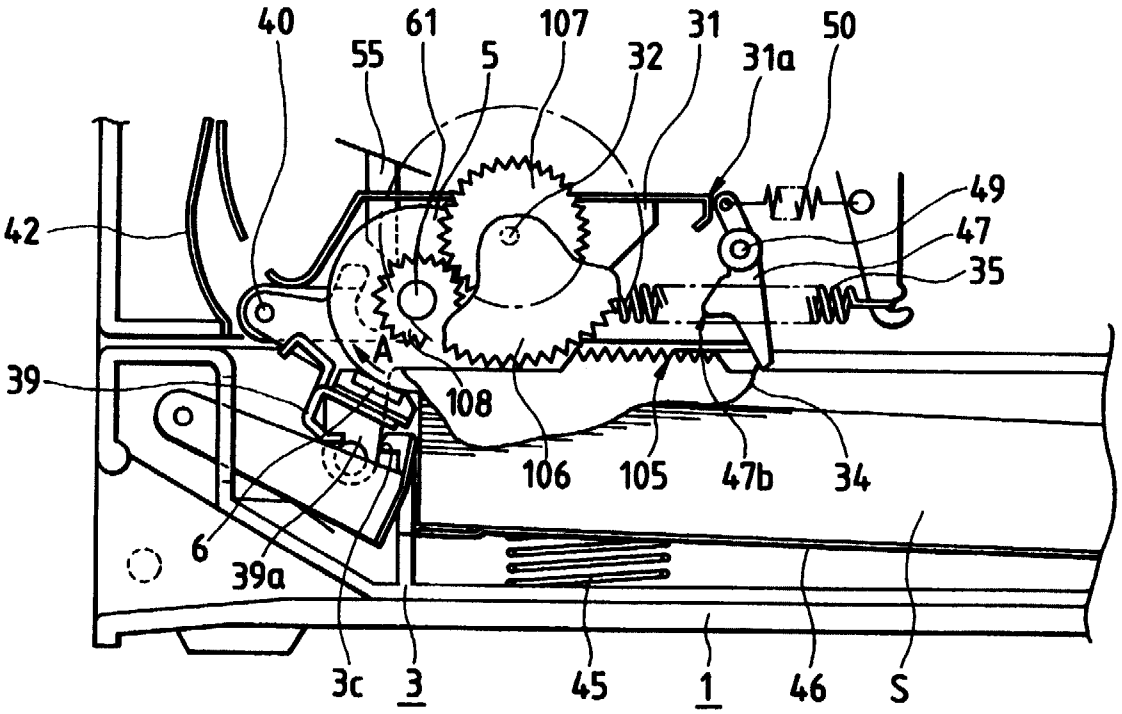
FIGS. 12 to 27 illustrate further embodiments of the invention.
Figure 13:
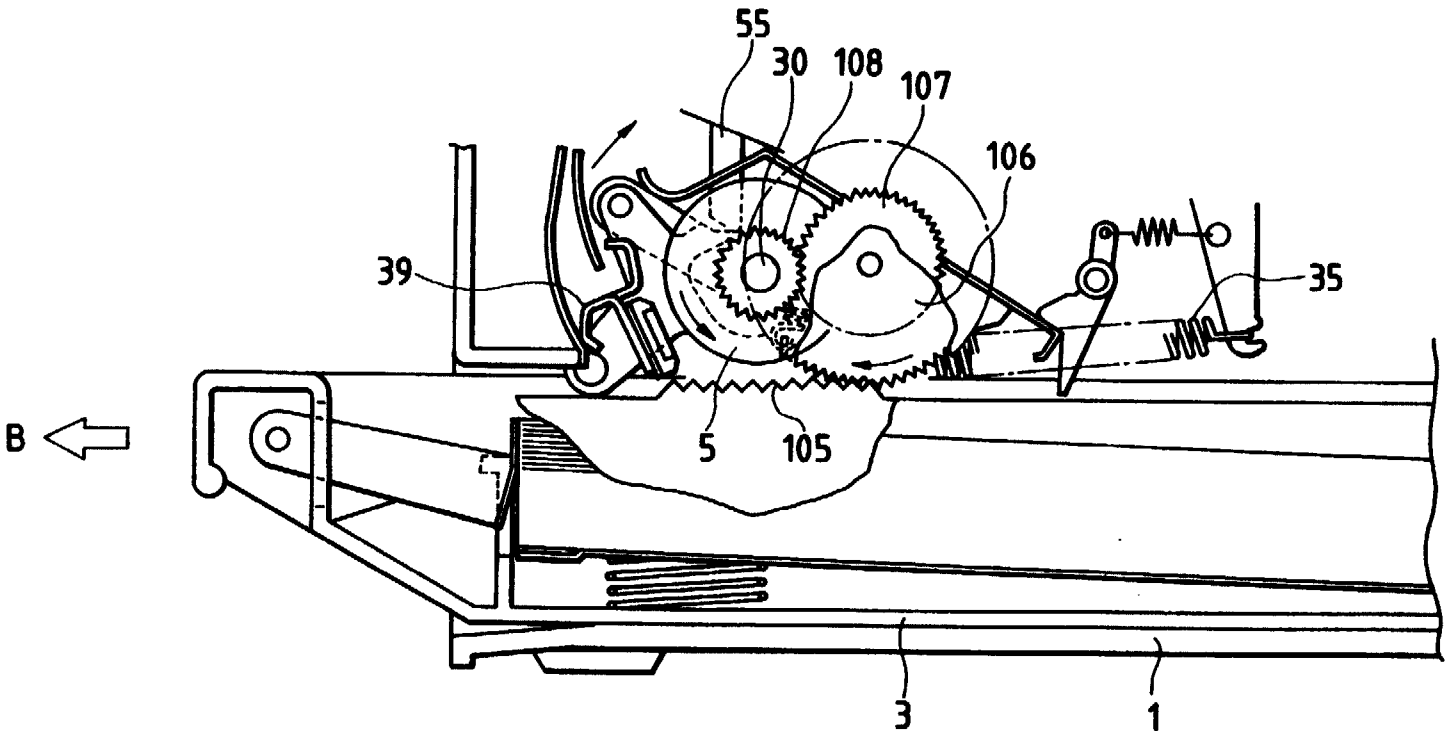

In the above embodiment, feeding roller 5 is reversed in a linked relation to the movement of the sheet-feeding unit. FIGS. 12 and 13 show an embodiment, in which rack 105 is provided on the cassette side for the reversal of the feeding roller. More specifically, as shown in FIG. 13, in this embodiment the operation of withdrawing cassette 3 from housing 1 causes rotation of gear 106 in mesh with the rack, the rotation being transmitted to gear 107 secured to the shaft of gear 106 and then to gear 108 secured to feeding roller shaft 30 to cause reversal of feeding roller 5.

In this embodiment, cassette 3 is provided with fly-away prevention member 111 and spring 112. Fly-away prevention member 111 is rotatable about shaft 113. When cassette 3 is in housing 1, flyaway prevention member 111 is held retreated by contact portion 39*c* of the sheet-feeding unit so that it will not interfering with the sheet-feeding operation.

When cassette 3 is not inserted in housing 1, engaging portion 114 of fly-away prevention member 111 is held raised by spring 112. In this state, engaging portion 114 is blocking the front ends of sheets, thus preventing the sheets from flying away from cassette 3.

Figure 14:
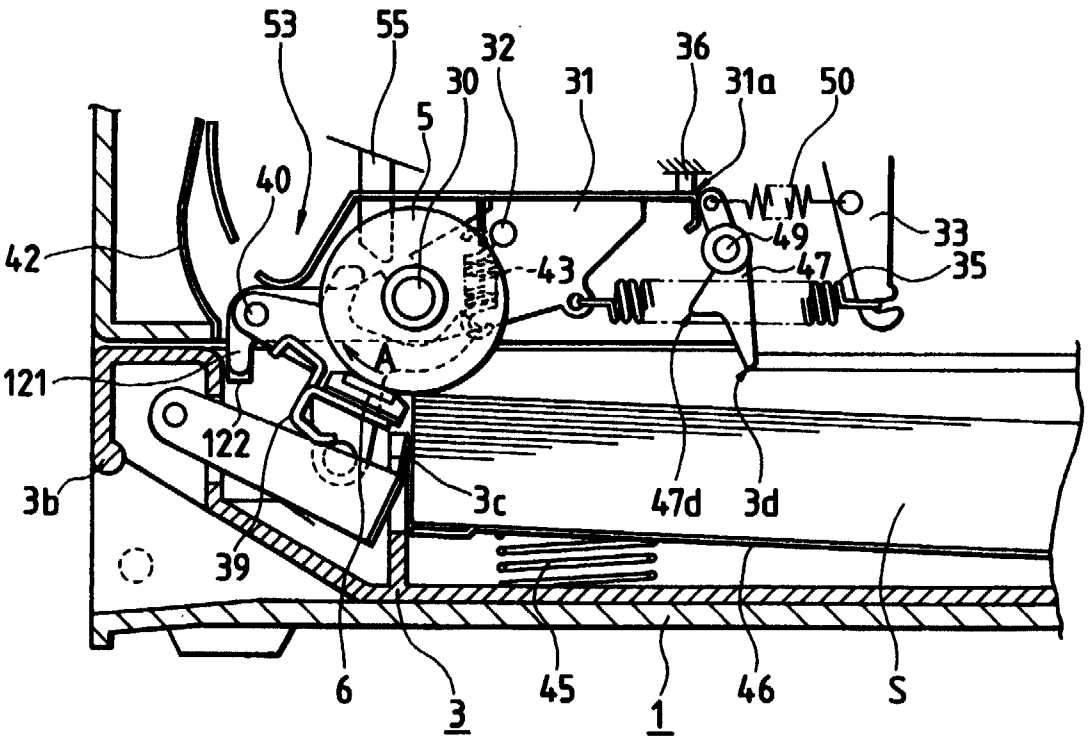
Figure 15:
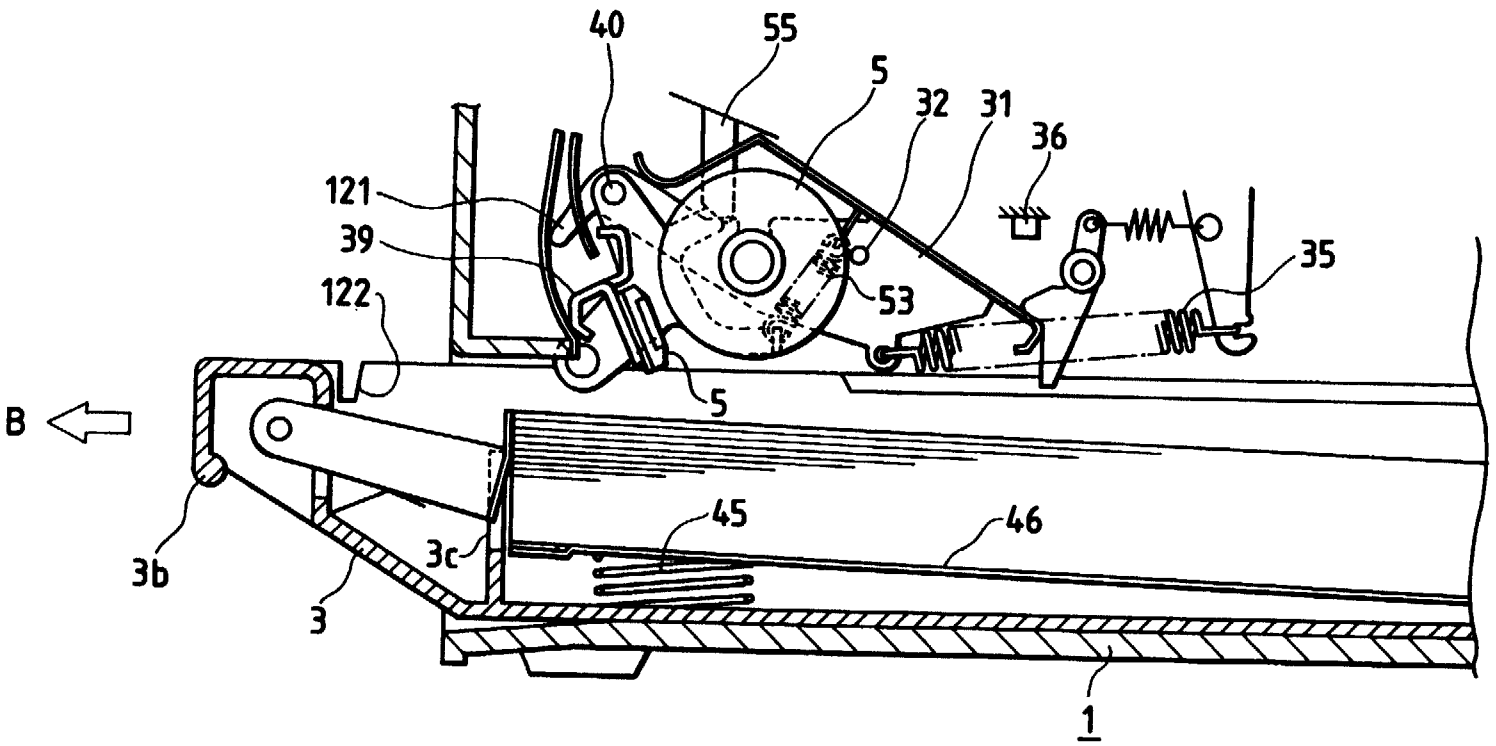

FIGS. 14 and 15 show a further embodiment of the invention.

Referring to these Figures, side plate 31 is provided with projection 121, while a side wall of cassette 3 is provided with recess 122. In the state shown in FIG. 14 in which cassette 3 is loaded at a predetermined position in housing 1 and sheet-feeding unit 3 is at the sheet-feeding position, projection 121 is engaged in recess 122, preventing cassette 3 from being withdrawn from the housing with the rotation of feeding roller 5.

When cassette 3 is withdrawn by gripping grip 3*b*, projection 121 is pushed by the wall of recess 122 to cause clockwise rotation of side plate 31 about shaft 32. When cassette 3 is further withdrawn, front wall 3*c* of cassette 3 pushes support 39 to cause further rotation of sheet-feeding unit 53. Sheet-feeding unit 53 is thus moved to its retreated position.

When loading cassette 3, sheet-feeding unit 53 is moved to the sheet-feeding operation by the operation as described above in connection with the above embodiment.

Figure 16:
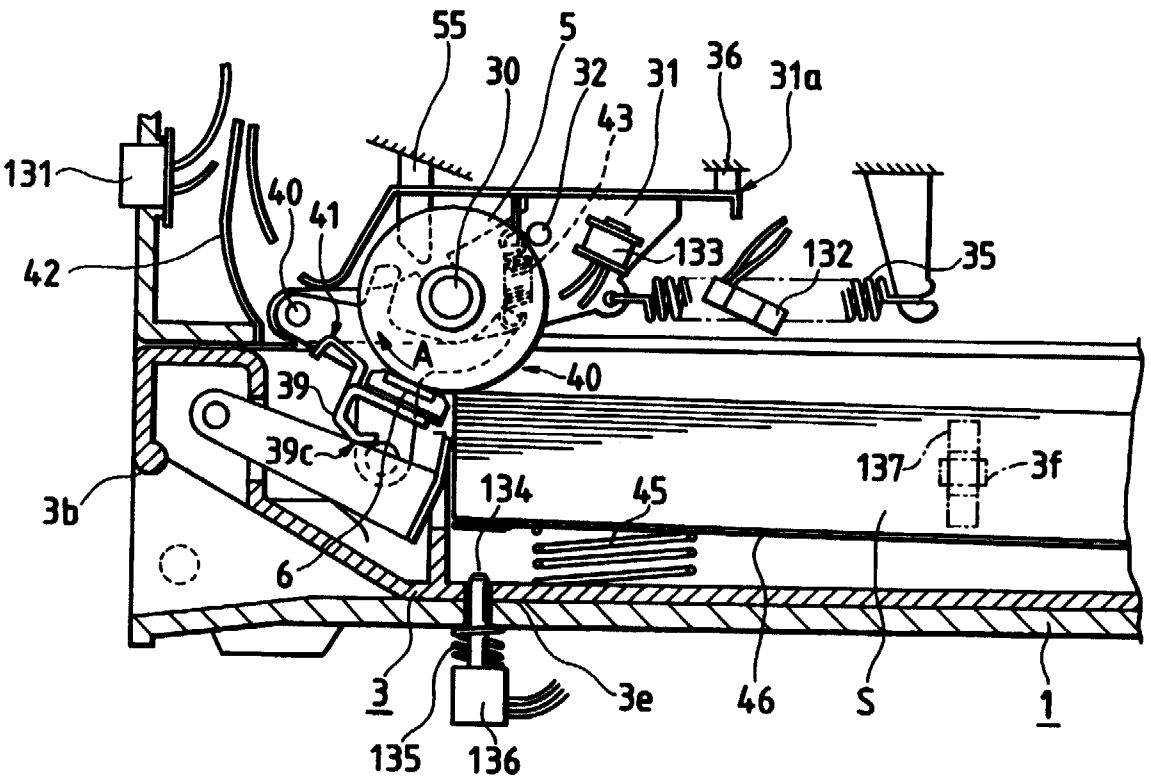
Figure 17:
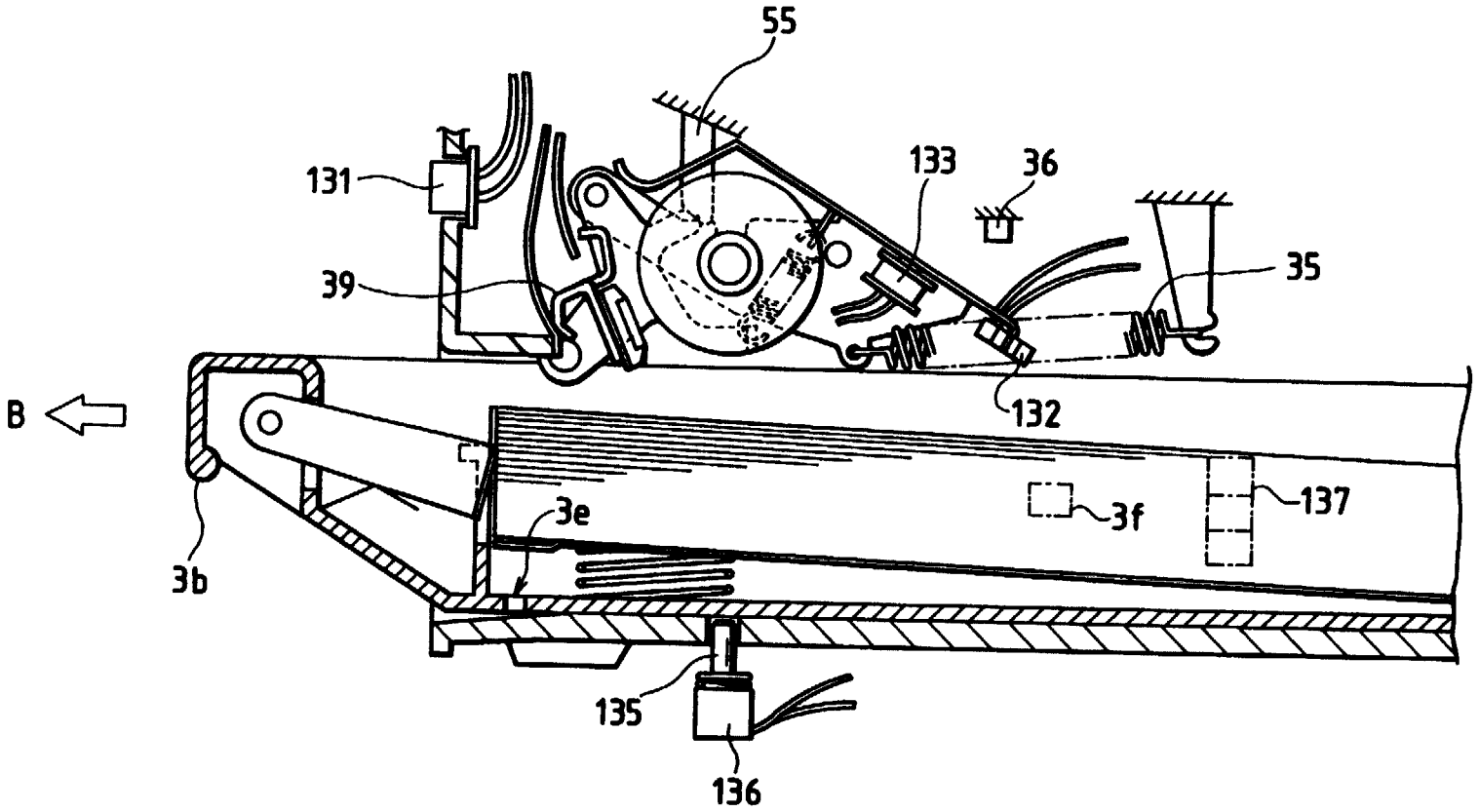
Figure 18:
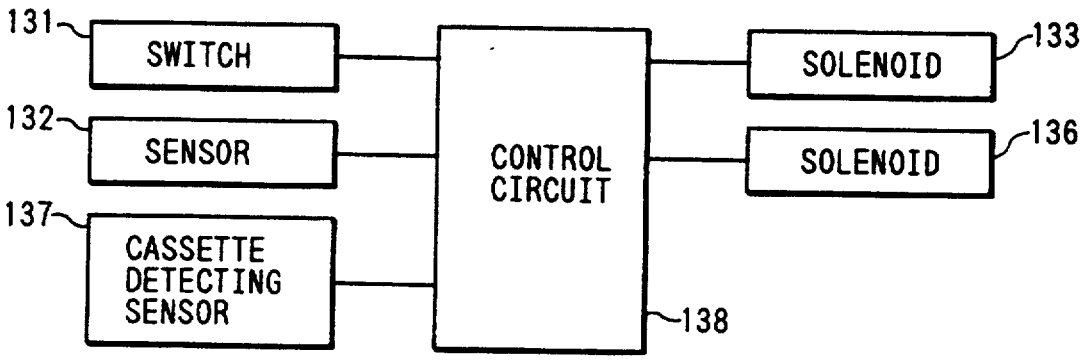

FIGS. 16 and 18 show a further embodiment. In these Figures, reference numeral 131 designates a switch for starting the operation of moving cassette 3 in the detaching direction, 132 designates a sensor for detecting that side plate 31 is at its retreated position, and designates 133 a solenoid for holding side plate 31 at its retreated position. Plunger 134 engages in engagement hole 3*e* provided in cassette 3. Plunger 134 is biased by spring 135 to be engaged in engagement hole 3*e* and hold cassette 3 at a predetermined loaded position. Reference numeral 136 designates a solenoid for moving plunger 134 to a position out of engagement with engagement hole 3*e* against the biasing force of spring 135, 137 cassette sensor provided on the housing, 3*f* designates a projection provided on a side wall of the sheet accommodation section, and 138 designates a control circuit.

Figure 19:
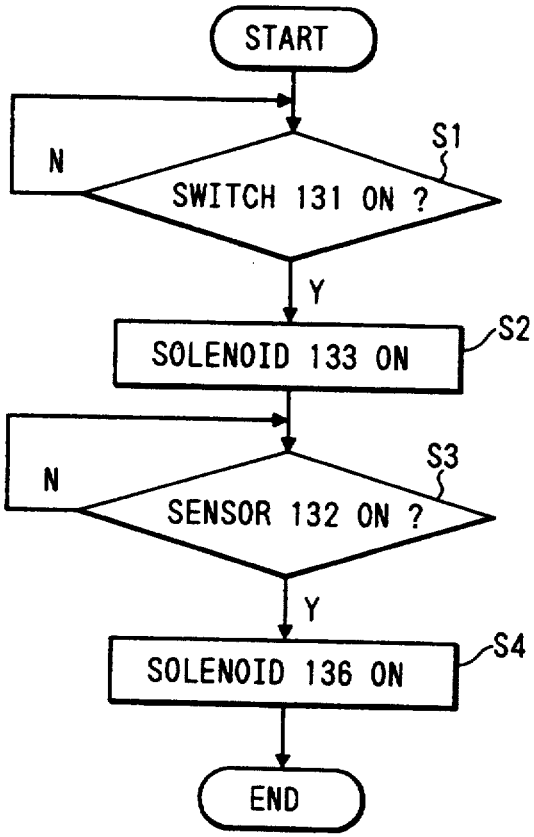

FIG. 19 is a flow chart of the operation to let cassette 3 be ready for withdrawal. When step S1 detects that switch 131 is "on", solenoid 133 is energized (step S2). Solenoid 133 thus provides an attraction force to cause clockwise rotation of side plate 31 to the retreated position as shown in FIG. 16 and hold the same at that position. With the rotation of side plate 31 to the retreated position, sensor 132 is turned on (step S3). Solenoid 136 thus is energized to move plunger 134 to the out-of-engagement position (step S4). Cassette 3 is now ready to be withdrawn.

Figure 20:
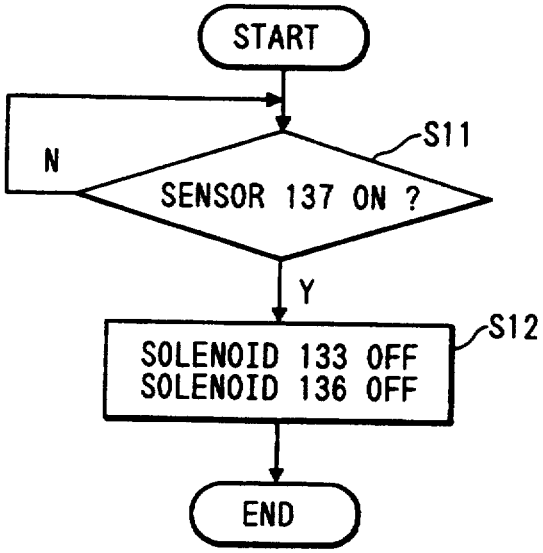

FIG. 20 is a flow chart of the operation to load cassette 3. When cassette 3 is operated from the withdrawn position to a predetermined loaded position, projection 3*f* on its side wall turns on cassette sensor 137. In consequence, step S11 detects that cassette sensor 137 is "on", whereupon solenoid 133 is de-energized to permit movement of side plate 31 to the sheet-feeding position by spring 35. At the same time, solenoid 136 is de-energized. Plunger 134 is thus moved by spring 135 to the engagement position, thus locking cassette 31 against movement.

Figure 21:
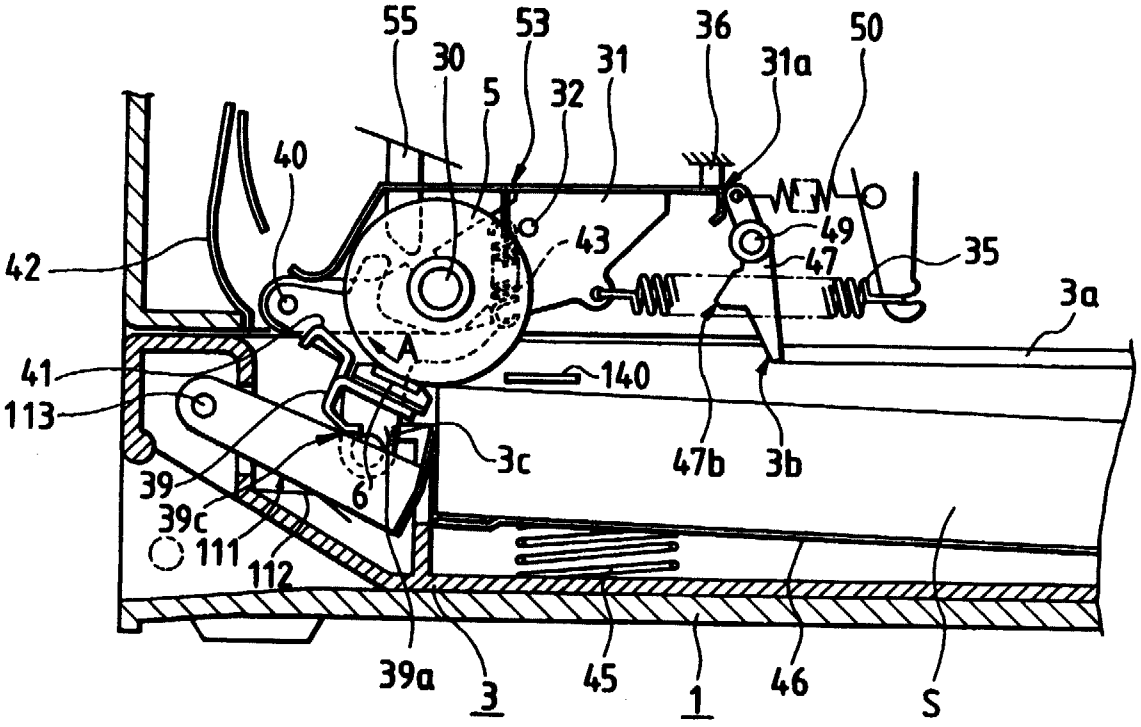
Figure 22:
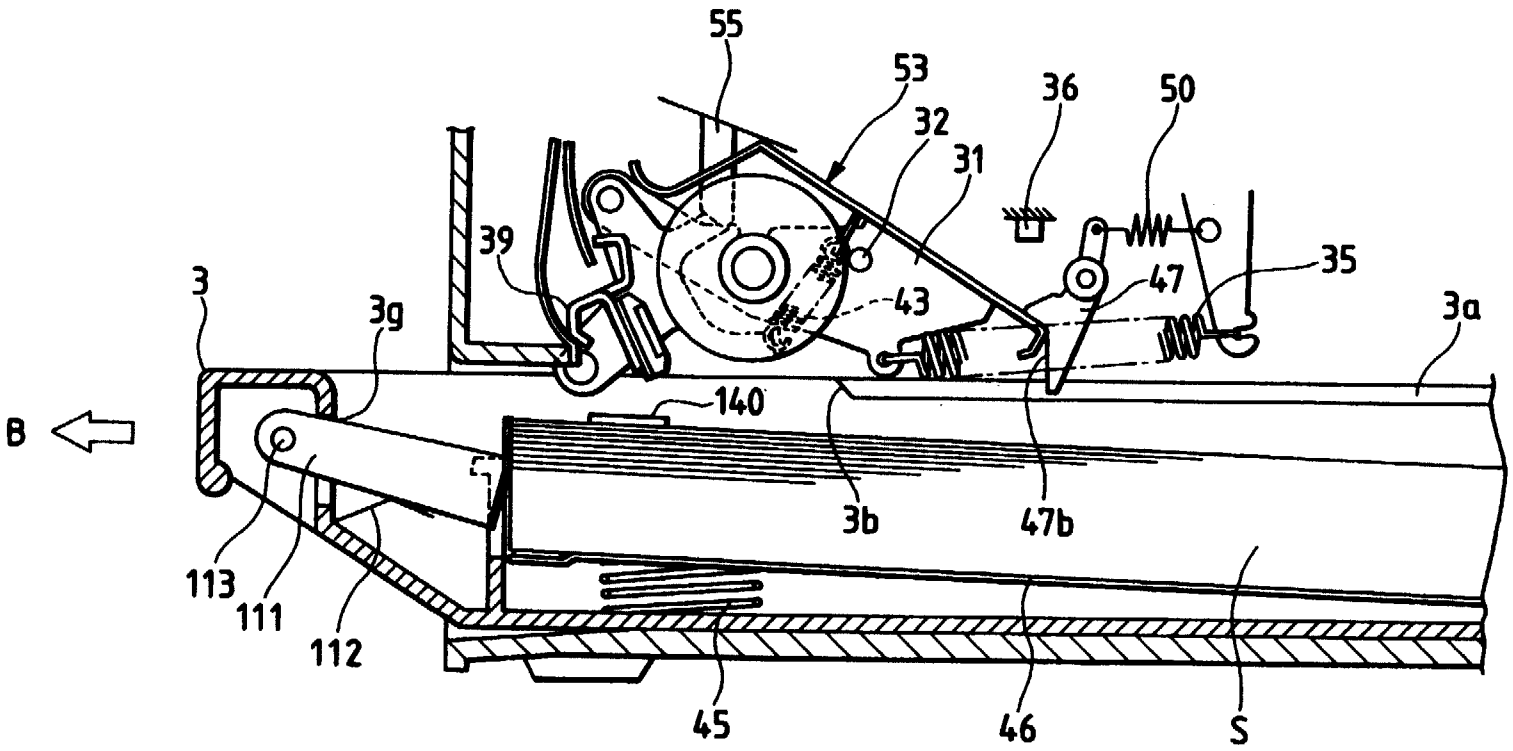

FIGS. 21 and 22 show a further embodiment. Referring to FIG. 21, cassette 3 is provided with top surface restriction member 140 as means for restricting the position of the top surface of the stack of sheets S when it is taken out from housing 1 as shown in FIG. 22.

When feeding roller 5 is retreated with withdrawal of cassette 3, inner plate 46 and stack of sheets are pushed upwards by the biasing force of spring 45. However, upward movement is restricted by the engagement of the top of the sheet stack with the top surface restriction member 140. With the upward movement of the contact portion 39*c* of support 39, fly-away prevention member 111 is also upwardly moved by spring 112 until it engages with engaging portion 3*g*, thus restricting the front ends of sheets to prevent the sheets from flying away from cassette 3.

Figure 23:
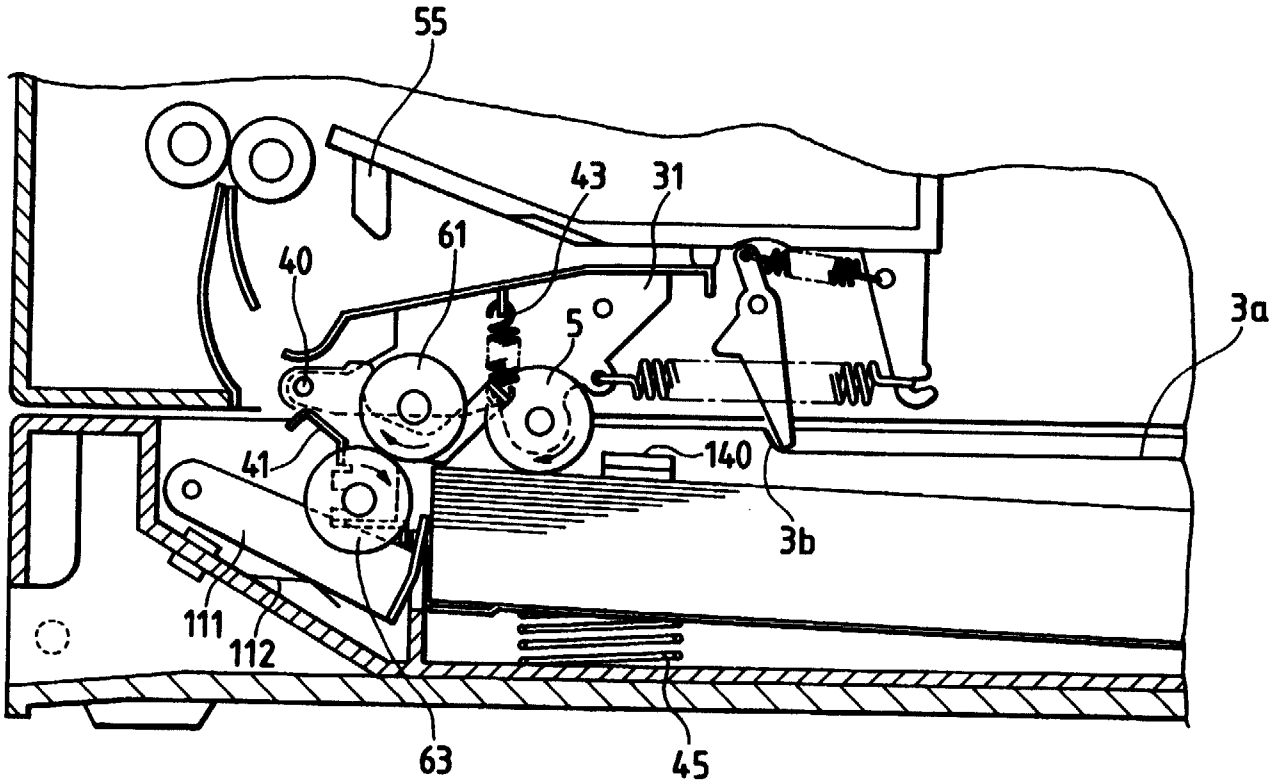
Figure 24:
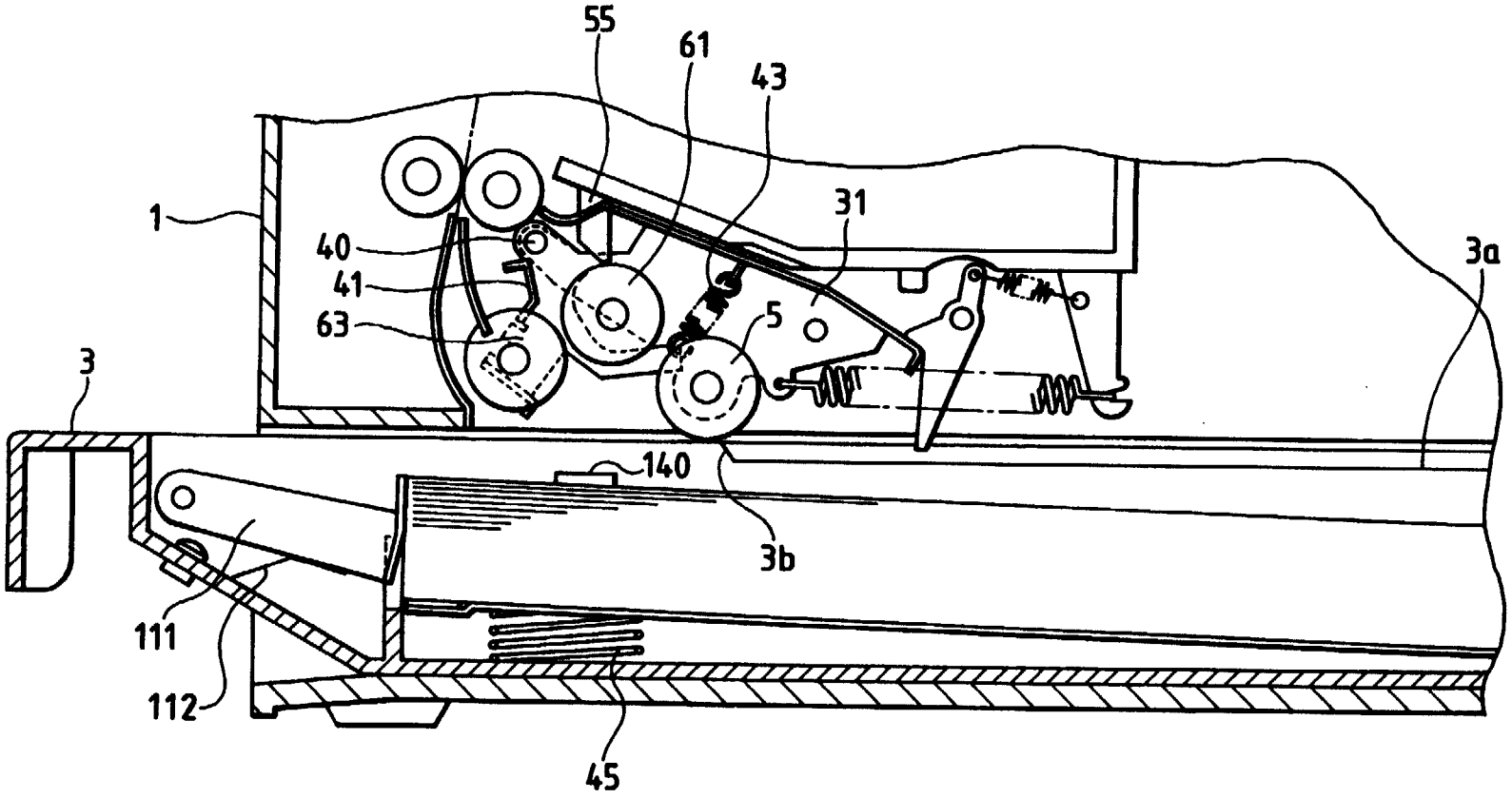

FIGS. 23 and 24 show a further embodiment of the invention. In this embodiment, separating roller 63 is used in lieu of the separating pad for separating sheets. More specifically, side plate 31 is provided with feeding roller 5 and transporting roller 61, and transporting roller 61 is located downstream side of roller 5 and rotated in the same direction as roller 5, thus providing a transporting force to sheets. Support 41 is provided with separating roller 63, which is urged against transporting roller 61 by the biasing force of spring 43 and rotated in the same direction as transporting roller 61 to provide a transporting force in the direction to opposite that provided by the transporting roller 61 to sheets. Separating roller 63 is connected via a clutch to a drive power source (not shown). When only a single sheet is fed to between transporting roller 61 and separating roller 63, the clutch causes idling of separating roller 63 relative to the drive power source. Separating roller 63 is thus rotated by the sheet. When a plurality of sheets are fed at a time, the clutch transmits the drive force, and the sheets other than the uppermost sheet are fed back with the rotation of separating roller 63, and thus only a single sheet is fed.

With the sheet feeder having the above construction, by moving cassette 3 in the withdrawing direction as shown in FIG. 24, like the above embodiment side plate 31 is rotated to move feeding roller 5, transporting roller 61 and separating roller 62 to their retreated positions. With the movement of feeding roller 5, the stacked sheets are pushed upwards by spring 45. However, the upward movement of the sheets is restricted by the engagement of the uppermost sheet with top surface restriction member 140.

Figure 25:
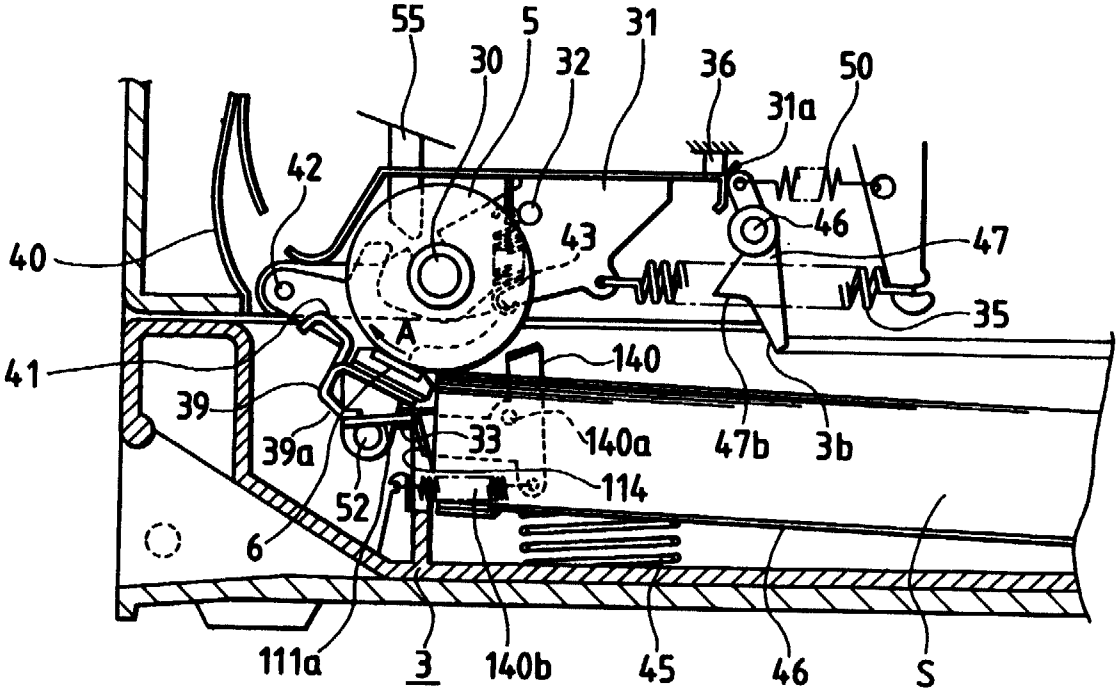
Figure 26:
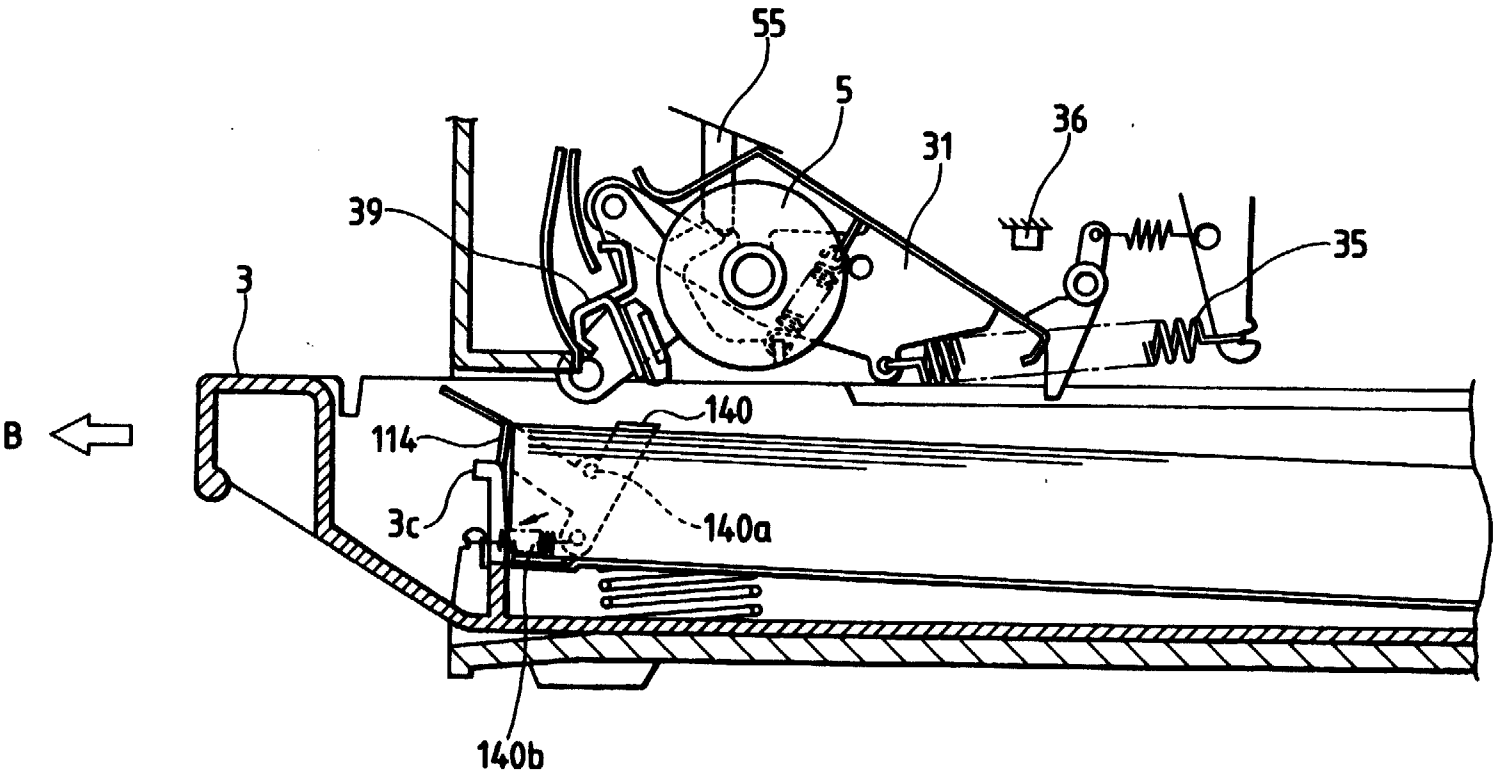
Figure 27:
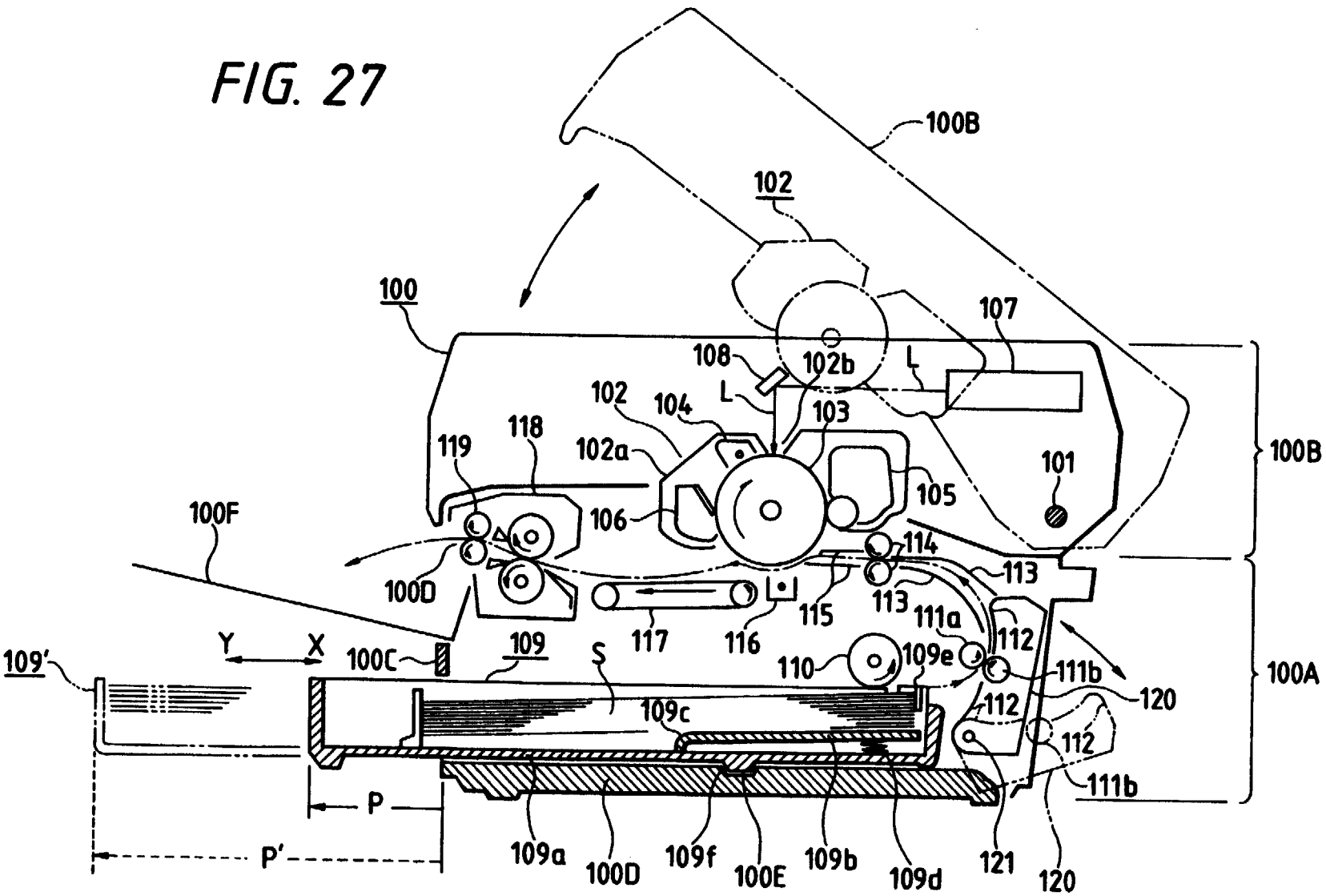

FIGS. 25 and 26 show a further embodiment. In this embodiment, top surface restriction member 140 and fly-away prevention member 114 are made integral with each other, and they are supported for rotation about shaft 140*a* and biased clockwise by spring 140*b*.

When cassette 3 is at its sheet-feeding position as shown in FIG. 25, contact portion 39*a* of support 39 is in contact with and downwardly urging contact portion 111*a* of fly-away prevention member 114. Thus, fly-away prevention member 114 is held at a lower retreated position so that it will not interfere with the feeding of sheets. Also, top surface restriction member 140 made integral with member 114 is held at a position upwardly spaced apart from the top surface of the sheet stack.

When cassette 3 is moved in the withdrawing direction from its sheet-feeding position as shown in FIG. 26, support 37 is pushed by contact portion 3*c* of cassette 3, thus causing clockwise rotation of side plate 31 to move feeding roller 5 and separating pad 6 to the retreated positions.

At this time, contact portion 39*a* of support 39 is also upwardly moved to release contact portion 114 of fly-away prevention member 111, and fly-away prevention member 114 restricts the front ends of sheets with the biasing force of spring 140*b*. Further, top surface restriction member 140 is in contact with and restricts the position of the uppermost surface of the sheet stack.

What is claimed is:

1. A sheet feeding apparatus comprising:

sheet accommodation means for accommodating sheets therein and drawable in a predetermined direction from said sheet feeding apparatus;

feeding means for feeding the sheets accommodated in said sheet accommodation means held at a sheet-feeding position;

friction means, disposed in front of the sheets accommodated in said sheet accommodating means at the sheet feeding position in the draw-out direction of said sheet accommodating means, for separating the sheets fed out from said feeding means one by one by friction; and support means for supporting said feeding means and said friction means such that said feeding means and said friction means can be moved to a first position for separating a sheet and to a second position for permitting movement of said sheet accommodation means in said predetermined drawing direction.

2. The sheet feeding apparatus according to claim 1, wherein said support means holds said friction means at said first position when said sheet accommodation means is in said sheet feeding position and holds said friction means at said second position when said sheet accommodation means is drawn in said predetermined direction.

3. The sheet feeding apparatus according to claim 1, wherein said friction means faces said feeding means and separates a sheet in cooperation with said feeding means.

4. The sheet feeding apparatus according to claim 3, wherein said friction means is more spaced apart from said feeding means when it is located at said second position than when it is located at said first position.

5. The sheet feeder according to claim 1, wherein said friction means faces transporting means disposed downstream side of said feeding means and separates a sheet in co-operation with said transporting means.

6. The sheet feeding apparatus according to claim 1, wherein said friction means is moved from said first position to said second position in an interlocked relation to movement of said sheet accommodation means in said predetermined direction.

7. The sheet feeder according to claim 1, which further comprises locking means for restricting the movement of said sheet accommodation means from said sheet-feeding position.

8. A sheet feeding apparatus according to claim 1, further including biasing means for biasing said support means in a direction so that said feeding means and friction means are held at the first position.

9. A sheet feeding apparatus according to claim 8, further including locking means for locking said support means so that said feeding means and friction means are held at the second position against bias force by said biassing means.

10. A sheet feeding apparatus according to claim 1, wherein a restriction member for restricting the front end of the sheet contained in drawer of said sheet accommodation means is provided on said sheet accommodation means.

11. A sheet feeding apparatus, comprising:

a sheet accommodation means for accommodating sheets therein and drawable in a predetermined direction from said sheet feeding apparatus;

feeding means for feeding out the sheets accommodated in said sheet accommodation means held at a sheet-feeding position;

friction means, disposed in front of the sheets accommodated in said sheet accommodating means at the sheet feeding position in the draw-out direction of said sheet accommodating means, for separating the sheets fed out from said feeding means one by one by friction;

support means for supporting said friction means such that said friction means is movable to a first position for separating a sheet and to a second position for permitting movement of said sheet accommodation means in said predetermined drawing direction;

biasing means for biasing said support means with a bias force in a direction so that said friction means is held at the first position; and locking means for locking said support means so that said friction means is held at the second position against the bias force by said biasing means.

12. The sheet feeding apparatus according to claim 11, wherein said support means supports said feeding means and said support means operates so that said friction means and said feeding means are held at said first position when said sheet accommodation means is located at said sheet-feeding position and are held at said second position when said sheet accommodation means is drawn in said predetermined drawing direction.

13. The sheet feeding apparatus according to claim 12, wherein said feeding means and said friction means are moved from said first position to said second position in an interlocked relation to movement of said sheet accommodation means in said predetermined direction.

14. The sheet feeding apparatus according to claim 11, wherein said friction means faces said feeding means and separating the sheets in co-operation with said feeding means.

15. The sheet feeder according to claim 11, which further comprises a rotary transporting member disposed downstream side of said rotary feeding member, said friction member separating a sheet in co-operation with said rotary transporting member.

16. A sheet feeding apparatus according to claim 11, wherein a restriction member for restricting the front end of the sheet contained in drawer of said sheet accommodation means is provided on said sheet accommodation means.

17. An image-forming apparatus comprising:

sheet accommodation means for accommodating sheets therein and drawable in a predetermined direction from said image-forming apparatus;

feeding means for feeding the sheets accommodated in said sheet accommodation means held at a sheet-feeding position;

friction means, disposed in front of the sheets accommodated in said sheet accommodating means at the sheet feeding position in the drawing direction of said sheet accommodation means for separating the sheets fed out from said feeding means one by one by friction;

support means for supporting said feeding means and said friction means such that said feeding means and said friction means can be moved to a first position for separating the sheets and to a second position for permitting movement of said sheet accommodation means in said predetermined drawing direction; and image forming means for forming an image on the sheet separated by and fed from said friction means.

18. An image-forming apparatus, comprising:

sheet accommodation means for accommodating sheets therein and drawable in a predetermined direction from said image-forming apparatus;

feeding means for feeding out the sheets accommodated in said sheet accommodation means held at a sheet-feeding position;

friction means, disposed in front of the sheets accommodated in said sheet accommodating means at the sheet feeding position in the draw-out direction of said sheet accommodating means for separating the sheets fed out from said feeding means one by one by friction;

support means for supporting said friction means such that said friction means is movable to a first position for separating a sheet and to a second position for permitting movement of said sheet accommodation means in said predetermined drawing direction;

biasing means for biasing said support means with a bias force in a direction so that said friction means is held at the first position;

locking means for locking said support means so that said friction means is held at the second position against the bias force by said biasing means; and image forming means for forming an image on the sheet separated by and fed from said friction member.

* * * * *

UNITED STATES PATENT AND TRADEMARK OFFICE

CERTIFICATE OF CORRECTION

PATENT NO. : 5,383,655

DATED : January 24, 1995

INVENTOR(S) : YASUYOSHI HAYAKAWA, ET AL.

It is certified that error appears in the above-indentified patent and that said Letters Patent is hereby corrected as shown below:

On the title page: Item [56]
line FPD, "59-4534 11/1984 Japan" should read --59-4534 1/1984 Japan--.

Column 4,
line 6, "Tonor" should read --Toner--;
line 34, "afore-mentioned" should read --aforementioned--; and
line 39, "into" should be deleted.

Column 5,
line 51, "withdrawing" should read --withdrawn--; and
line 60, "since" should be deleted.

Column 6,
line 22, "contact" should read --contact with--;
line 38, "like." should read --like,--; and
line 39, "Contact" should read --contact--.

Column 7,
line 66, "deemenergizes" should read --deenergizes--.

Column 9,
line 42, "interfering" should read --interfere--.

UNITED STATES PATENT AND TRADEMARK OFFICE

CERTIFICATE OF CORRECTION

PATENT NO. : 5,383,655

DATED : January 24, 1995

INVENTOR(S) : YASUYOSHI HAYAKAWA, ET AL.

It is certified that error appears in the above-indentified patent and that said Letters Patent is hereby corrected as shown below:

Column 10,
line 7, "desig-" should be deleted; and
line 8, "nates 133" should read --133 designates--.

Column 12,
line 19, "feeder" should read --feeding apparatus--;
line 22, "co-operation" should read --cooperation--;
line 28, "feeder" should read --feeding apparatus--; and
line 40, "biassing" should read --biasing--.

Column 13,
line 20, "separating" should read --separates--, and "co-operation" should read --cooperation--;
line 22, "feeder" should read --feeding apparatus--; and
line 25, "co-operation" should read --cooperation--.

Signed and Sealed this

Sixteenth Day of May, 1995

Bruce Lehman

*Attest:*

BRUCE LEHMAN

*Attesting Officer*

*Commissioner of Patents and Trademarks*